US010060152B2

(12) United States Patent
Ma

(10) Patent No.: US 10,060,152 B2
(45) Date of Patent: Aug. 28, 2018

(54) COMPONENTS FOR SHADE STRUCTURES

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 15/265,757

(22) Filed: Sep. 14, 2016

(65) Prior Publication Data

US 2017/0073993 A1 Mar. 16, 2017

Related U.S. Application Data

(60) Provisional application No. 62/218,450, filed on Sep. 14, 2015.

(51) Int. Cl.

| | |
|---|---|
| ***E04H 15/50*** | (2006.01) |
| ***A45B 25/06*** | (2006.01) |
| ***A45B 25/10*** | (2006.01) |
| ***E04H 15/18*** | (2006.01) |
| ***E04H 15/28*** | (2006.01) |

(Continued)

(52) U.S. Cl.

CPC ..... *E04H 15/50* (2013.01); *A45B 19/12* (2013.01); *A45B 23/00* (2013.01); *A45B 25/06* (2013.01); *A45B 25/10* (2013.01); *E04H 15/18* (2013.01); *E04H 15/28* (2013.01); *A45B 2019/004* (2013.01); *A45B 2023/0012* (2013.01); *A45B 2200/1072* (2013.01)

(58) Field of Classification Search

CPC ..... E04H 15/18; E04H 15/28; E04H 15/44; E04H 15/50; A45B 19/12; A45B 25/06; A45B 25/10; A45B 2025/105

USPC ..... 135/25.2, 29, 30, 120.3, 145, 147, 909

See application file for complete search history.

(56) References Cited

U.S. PATENT DOCUMENTS

| | | | |
|---|---|---|---|
| 331,231 | A | 11/1885 | Folger |
| 501,089 | A | 7/1893 | Lichtenstein |

(Continued)

FOREIGN PATENT DOCUMENTS

| | | |
|---|---|---|
| CA | 1269018 | 5/1990 |
| CN | 204444542 | 7/2015 |

(Continued)

OTHER PUBLICATIONS

International Search Report and Written Opinion issued in PCT Application No. PCT/US2016/051771, dated Dec. 28, 2016.

(Continued)

*Primary Examiner* — Robert Canfield

(74) *Attorney, Agent, or Firm* — Knobbe Martens Olson & Bear LLP

(57) ABSTRACT

A mount for a shade structure, in particular a collapsible pavilion. The mount has a base and a cover. The base has a space formed therein configured to receive a ground support of a shade structure. The cover has a top surface and a bottom surface to be secured to the base. A groove is formed in the mount and is configured to pivotably receive a rib. The groove is disposed between opposed walls of the mount. A pin retention recess is disposed on each side of the opposed walls in one of the cover and the base. A plurality of projections are provided that each have a first end fixed to one of the cover and the base in which the pin retention recess is not formed and a second end disposed away from the fixed end. One of the projections is configured to enclose a portion of the retention recess when the cover and the base are secured together.

28 Claims, 21 Drawing Sheets

(51) Int. Cl.

| | |
|---|---|
| ***A45B 19/12*** | (2006.01) |
| ***A45B 23/00*** | (2006.01) |
| *A45B 19/00* | (2006.01) |

(56) References Cited

U.S. PATENT DOCUMENTS 620,815 A 3/1899 Warren
750,178 A 1/1904 Fesenfeld
770,704 A * 9/1904 Vogel ..... A45B 25/06 135/30
847,805 A 3/1907 McAvoy
878,270 A 2/1908 Blake et al.
880,534 A 3/1908 Hoyt
897,026 A 8/1908 Seitzinger
928,169 A 7/1909 Bardon
941,952 A 11/1909 Riehl
947,790 A 2/1910 Carter
959,127 A 5/1910 Edwards
1,001,076 A 8/1911 Redford
1,022,944 A 4/1912 Hodinger
1,078,069 A 11/1913 Simons
1,107,415 A 8/1914 Drohan
1,264,075 A 4/1918 Hout
1,469,495 A 10/1923 Bunker
1,808,610 A 6/1931 Roy
2,101,510 A 12/1937 Rathbun
2,207,043 A 7/1940 Weiss et al.
2,321,495 A 6/1943 Levin
2,336,116 A 12/1943 Morando
2,385,575 A 9/1945 Isler
2,469,637 A 5/1949 Evans et al.
2,635,616 A 4/1953 Haydu
2,762,383 A 9/1956 Wittman
2,796,073 A 6/1957 Wittman
2,860,647 A 11/1958 Negri
2,914,154 A 11/1959 Russell
3,157,186 A 11/1964 Hammer
3,177,882 A 4/1965 Vincent
3,424,180 A 4/1966 Andolfi
3,252,468 A 5/1966 Militano
3,330,582 A 7/1967 Morris
3,462,179 A 8/1969 Hinkle
3,557,809 A 1/1971 Vazquez et al.
3,643,673 A 2/1972 Weber
3,704,479 A 12/1972 Whitaker
D231,955 S 6/1974 Weber
4,201,237 A 5/1980 Watts et al.
4,368,749 A 1/1983 Lindler et al.
4,369,000 A 1/1983 Egnew
4,627,210 A 12/1986 Beaulieu
4,673,308 A 6/1987 Reilly
4,750,509 A 6/1988 Kim
4,790,338 A 12/1988 Strobl
4,941,499 A 7/1990 Pelsue et al.
4,966,178 A 10/1990 Eichhorn
D320,111 S 9/1991 Ma
5,056,291 A 10/1991 Leung
D321,779 S 11/1991 Ma
5,069,572 A 12/1991 Niksic
5,085,239 A 2/1992 Chin-Hung et al.
5,188,137 A 2/1993 Simonelli
5,193,566 A * 3/1993 Chen ..... A45B 25/02 135/28
5,328,286 A * 7/1994 Lee ..... E04H 15/48 135/135
D360,522 S 7/1995 Ko
5,433,233 A 7/1995 Shiran et al.
5,445,471 A 8/1995 Wexler et al.
5,738,129 A 4/1998 Vogt
5,740,824 A 4/1998 Tang
5,797,613 A 8/1998 Busby
5,797,695 A * 8/1998 Prusmack ..... E04H 15/32 135/145
5,842,494 A 12/1998 Wu
D411,655 S 6/1999 Tung
5,911,233 A 6/1999 Wu
D412,056 S 7/1999 Wang
6,076,540 A 6/2000 You
6,095,169 A 8/2000 Lin et al.
6,199,572 B1 3/2001 Rousselle et al.
6,227,753 B1 * 5/2001 Boer ..... G09F 1/06 403/170
6,311,706 B1 11/2001 Sato
6,314,976 B1 11/2001 Clarke
6,332,657 B1 12/2001 Fischer
6,345,637 B1 2/2002 Ko
6,354,316 B1 3/2002 Chen
6,374,840 B1 4/2002 Ma
6,386,215 B1 5/2002 Chang
6,397,867 B2 6/2002 You
D460,947 S 7/2002 Montena
D465,915 S 11/2002 Earnshaw
6,604,844 B2 8/2003 Hussey
6,643,889 B1 11/2003 Kotlarski
6,701,946 B2 3/2004 You
6,705,335 B2 3/2004 You
6,758,228 B1 7/2004 You
6,758,354 B2 * 7/2004 Carletti ..... G09F 15/0068 211/182
6,814,093 B2 11/2004 You
7,178,535 B2 2/2007 Eder
7,464,503 B2 12/2008 Hoberman
7,481,235 B2 1/2009 Prusmack
7,574,777 B1 8/2009 Fuller et al.
7,637,276 B2 * 12/2009 Mallookis ..... E04H 15/50 135/131
7,703,464 B2 4/2010 Ma
D623,396 S 9/2010 He
D626,324 S 11/2010 Ma
7,861,734 B2 1/2011 Ma
D631,848 S 2/2011 Montena et al.
7,891,367 B2 * 2/2011 Ma ..... A45B 25/02 135/19.5
8,061,375 B2 11/2011 Ma
8,069,872 B2 12/2011 Bae
8,082,935 B2 12/2011 Ma
8,082,937 B2 12/2011 Tarter et al.
8,166,986 B2 * 5/2012 Ma ..... A45B 25/02 135/19.5
D661,659 S 6/2012 Natoli et al.
D662,064 S 6/2012 Natoli et al.
D668,446 S 10/2012 Patzak
D670,901 S 11/2012 Rothbucher et al.
8,356,613 B2 1/2013 Ma
8,360,085 B2 1/2013 Lee
8,485,208 B2 7/2013 Seo
8,496,019 B2 7/2013 Zhou
8,555,905 B2 10/2013 Ma
D719,342 S 12/2014 Ma
D719,343 S 12/2014 Ma
9,078,497 B2 * 7/2015 Ma ..... A45B 25/10
D738,609 S 9/2015 Ma
9,192,215 B2 * 11/2015 Ma ..... A45B 25/10
D744,742 S 12/2015 You
D749,835 S 2/2016 Whitaker
D750,364 S 3/2016 Lah
9,433,269 B2 * 9/2016 Ma ..... A45B 25/10
9,498,030 B2 * 11/2016 Ma ..... A45B 25/06
D786,661 S 5/2017 Wright
2001/0007260 A1 7/2001 Rousselle et al.
2004/0025915 A1 * 2/2004 Wang ..... A45B 25/02 135/29
2004/0123891 A1 7/2004 Ma
2005/0115599 A1 6/2005 You
2006/0005867 A1 1/2006 Chang
2006/0124160 A1 6/2006 Lee
2007/0172310 A1 7/2007 Yang et al.
2009/0071518 A1 * 3/2009 Amsel ..... A45B 25/14 135/29
2009/0126769 A1 5/2009 Hoogendoorn
2009/0260664 A1 10/2009 Ma
2010/0288318 A1 11/2010 Beaulieu
2011/0017249 A1 1/2011 Ma
2011/0132418 A1 6/2011 Ma

(56) References Cited

U.S. PATENT DOCUMENTS

| | | | | |
|---|---|---|---|---|
| 2011/0214705 | A1* | 9/2011 | Ma | A45B 19/04 135/29 |
| 2012/0318316 | A1 | 12/2012 | Choi et al. | |
| 2013/0008478 | A1 | 1/2013 | Prieto | |
| 2013/0276843 | A1* | 10/2013 | Ma | A45B 25/06 135/28 |
| 2014/0026931 | A1* | 1/2014 | Lee | E04H 15/48 135/144 |
| 2015/0237977 | A1* | 8/2015 | Ma | A45B 25/10 135/28 |
| 2016/0115707 | A1* | 4/2016 | Schneider | E04H 15/32 135/120.3 |
| 2017/0112242 | A1* | 4/2017 | Ma | A45B 25/06 |

FOREIGN PATENT DOCUMENTS

| | | |
|---|---|---|
| DE | 1152226 | 8/1963 |
| EP | 0202769 | 12/1989 |
| EP | 0897678 | 2/1999 |
| FR | 855628 | 5/1940 |
| FR | 002650491 | 2/1991 |
| FR | 2857835 | 1/2005 |
| GB | 2113543 | 8/1983 |
| GB | 2165448 | 11/1987 |
| JP | 61131921 | 8/1986 |
| KR | 100851744 | 8/2008 |
| KR | 10-2009-0110808 | 10/2009 |
| KR | 10-2012-0107607 | 10/2012 |
| WO | WO 2005/023042 | 3/2005 |
| WO | WO 2017/048868 | 3/2017 |

OTHER PUBLICATIONS

2017/0112242 including its prosecution history, Apr. 27, 2017, Ma.

EPO Extended Search Report dated Apr. 5, 2011 for European Patent No. 09252140.0, filed Sep. 7, 2009.

Extended European Search Report issued in EP Application No. 14157685, dated Jul. 7, 2014, in 8 pages.

Extended European Search Report issued in EP Application No. 14158057, dated Jul. 7, 2014, in 7 pages.

Extended European Search Report issued in EP Application No. 15156587.6, dated Jul. 23, 2015, in 7 pages.

Treasure Garden, 2010 Products Catalog, pp. 20 and 60, 94 pp.

* cited by examiner

COMPONENTS FOR SHADE STRUCTURES

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND OF THE INVENTION

Field of the Invention

This application is directed to shade structures, for example collapsible portable shelters and umbrellas.

Description of the Related Art

Collapsible shade structures are popular devices used to provide shelter in a wide variety of conditions. These portable shelters are ubiquitous at sporting events, particularly in hot and sunny weather. These structures protect users from the sun so that sporting events, parties, and other outdoor events and activities can be more enjoyable.

SUMMARY OF THE INVENTION

Manufacturers and users of collapsible tent shade structures would benefit from improvement in the design of these structures to make them more efficient to manufacture, use, and maintain.

In one embodiment, a shade structure is provided that includes at least one ground support having a lower end and an upper end. The shade structure also includes an upper mount, a first rib, a moveable mount, and a second rib. The upper mount is coupled with the upper end of the at least one ground support. The upper mount has at least one groove. The first rib has a first end coupled with the upper mount in the groove thereof. The first rib has an elongate body that extends away from the first end. The moveable mount has an aperture disposed around the at least one ground support. The aperture is configured to allow the moveable mount to move along the at least one ground support. The moveable mount has a groove. The second rib has a first end coupled with the moveable mount in the groove thereof. The second rib has an elongate body that extends away from the first end. At least one of the upper mount and the moveable mount comprises a base configured to receive a corresponding rib in a groove thereof. The groove of the base of the upper mount can be configured to receive the first end portion of the first rib therein. The groove of the base of the moveable mount can be configured to receive the first end portion of the second rib therein. At least one of the upper mount and the moveable mount comprises a cover configured to secure the first end of the corresponding rib in the groove when the cover is coupled with the base.

In another embodiment, a mount is provided for a shade structure, such as a portable pavilion or an umbrella. The mount includes a base that has a space formed therein that is configured to receive a ground support. The ground support can be a leg of a pavilion frame or an umbrella pole, for example. The mount includes at least one groove configured to pivotably receive a rib. The groove is disposed between opposed walls of the base. The opposed walls each have a pin retention recess disposed therein. The mount also includes a cover that has a top surface, a bottom surface, and a plurality of projections having a first end fixed to the bottom surface of the cover and a second end disposed away from the bottom surface. One of the projections is configured to enclose a portion of the retention recess.

In one variation of the foregoing mount for a shade structure, one of the projections is configured to secure the cover to the base.

In another embodiment, a mount for a shade structure is provided. The mount has a base and a cover. The base has a space formed therein configured to receive a ground support of a shade structure. The cover has a top surface and a bottom surface to be secured to the base. A groove is formed in the mount and is configured to pivotably receive a rib. The groove is disposed between opposed walls of the mount. A pin retention recess is disposed on each side of the opposed walls in one of the cover and the base. A plurality of projections are provided that each have a first end fixed to one of the cover and the base in which the pin retention recess is not formed and a second end disposed away from the fixed end. One of the projections is configured to enclose a portion of the retention recess when the cover and the base are secured together.

BRIEF DESCRIPTION OF THE DRAWINGS

The abovementioned and other features of the inventions disclosed herein are described below with reference to the drawings of the preferred embodiments. The embodiments are intended to illustrate, but not to limit the inventions. The drawings include the following figures.

DETAILED DESCRIPTION OF THE PREFERRED EMBODIMENT

This application is directed to improved components and assemblies for shade structures, including collapsible tents, pavilions and umbrellas.

Figure 1:
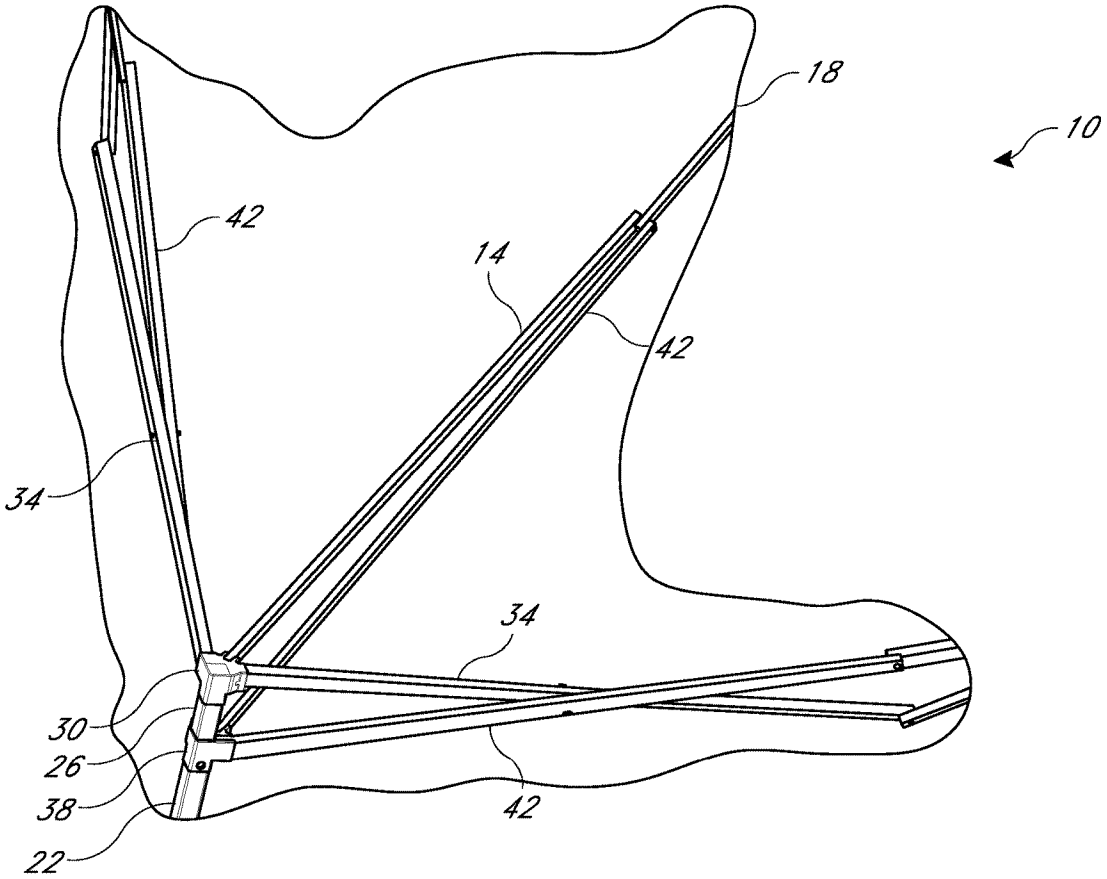
FIG. 1 is a top perspective view of a corner portion of a collapsible shade structure including embodiments of stationary and moveable mounts.

FIG. 1 shows a corner portion of a pavilion 10 configured to provide shade as a shade structure. The pavilion 10 includes a frame 14 and a cover 18. The cover 18 is disposed over a top portion of the frame 14 such that shelter can be provided beneath the cover 18. FIG. 1 shows a corner portion of the frame 14 that includes a leg 22. The leg is one example of a ground support that is used in a pavilion. The leg 22 has a lower end (not shown) and an upper end 26. The lower end of the leg 22 is adapted to couple with the ground. For example, the lower end of the leg 22 can have an enlarge foot portion to provide stable contact with the ground.

In one embodiment, the frame 14 includes an upper mount 30, a plurality of ribs 34 coupled with the upper mount 30, a moveable mount 38. The frame 14 also can include a plurality of ribs 42 coupled with the moveable mount 38. The ribs 34, 42 can be coupled to each other in a manner that permits the frame 14 to be folded, such that the pavilion 10 can be portable. For example, the ribs 34, 42 can be joined in a middle portion thereof. The ribs 34, 42 can be joined other ribs at ends opposite to ends that are coupled with the mounts 30, 38.

In another embodiment as discussed further below, the upper mount 30 can be configured as a top hub or top nest of an umbrella. The moveable mount 38 can be configured in other embodiments as a moveable hub, e.g., a runner of an umbrella.

Figure 2:
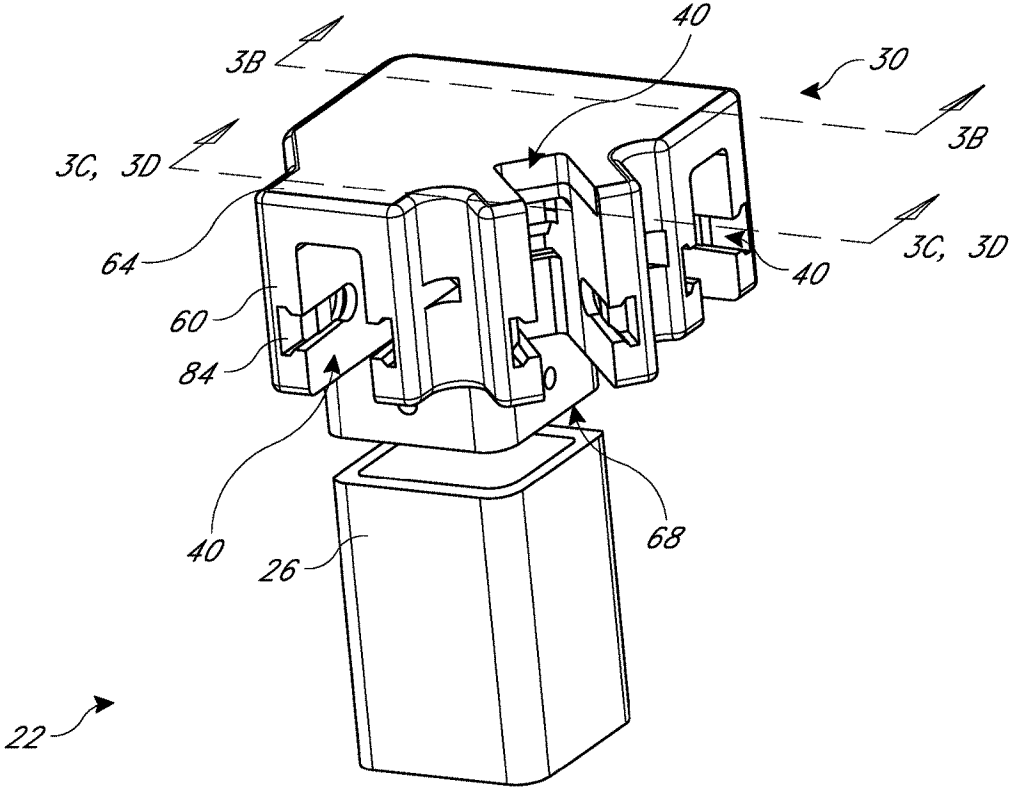
FIG. 2 is an exploded view of an upper mount assembly.
Figure 3:
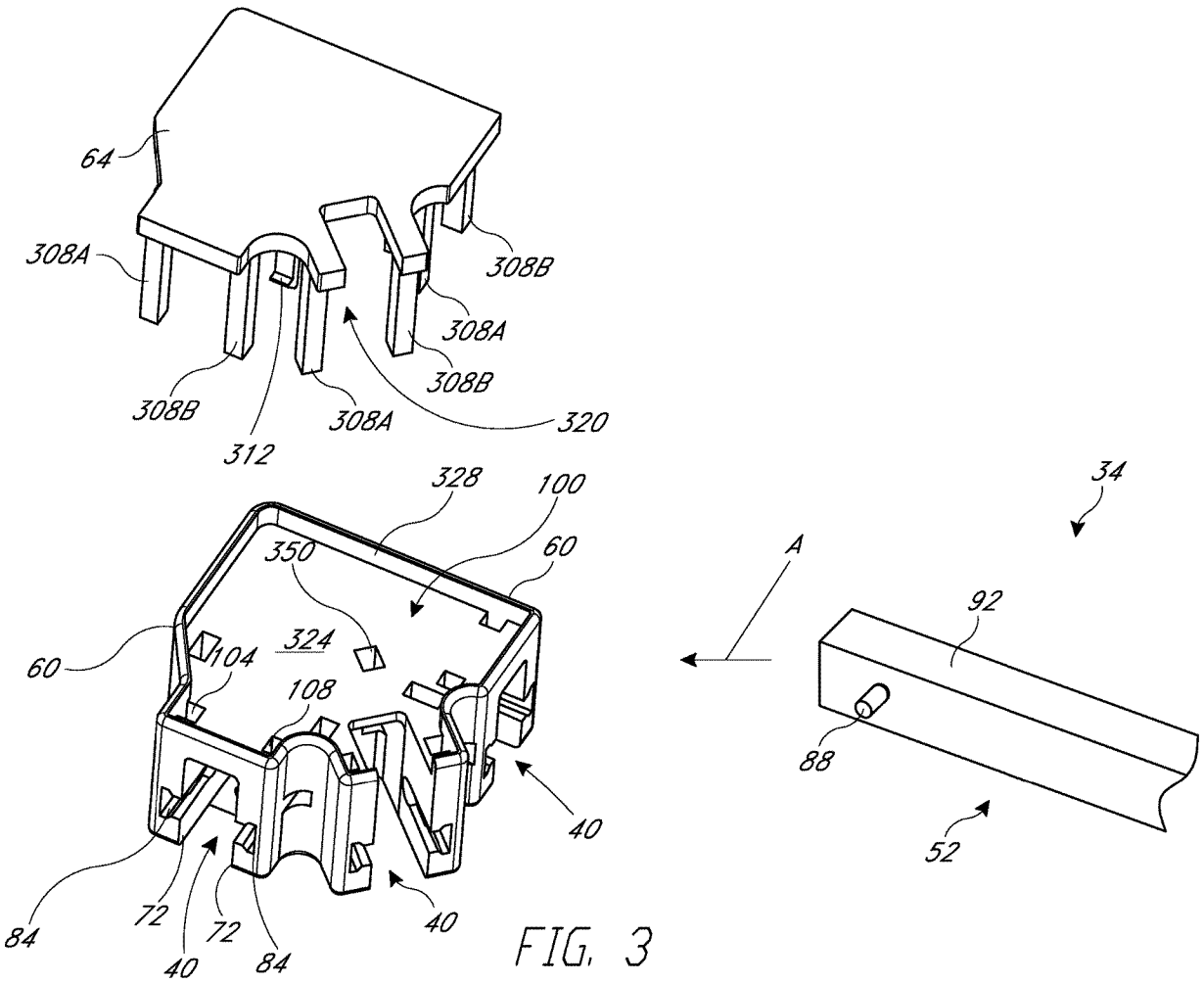
FIG. 3 is an exploded view of the upper mount of FIG. 2, also showing a rib that is coupled to the upper mount in an assembled shade structure as in FIG. 1.
Figure 3A:
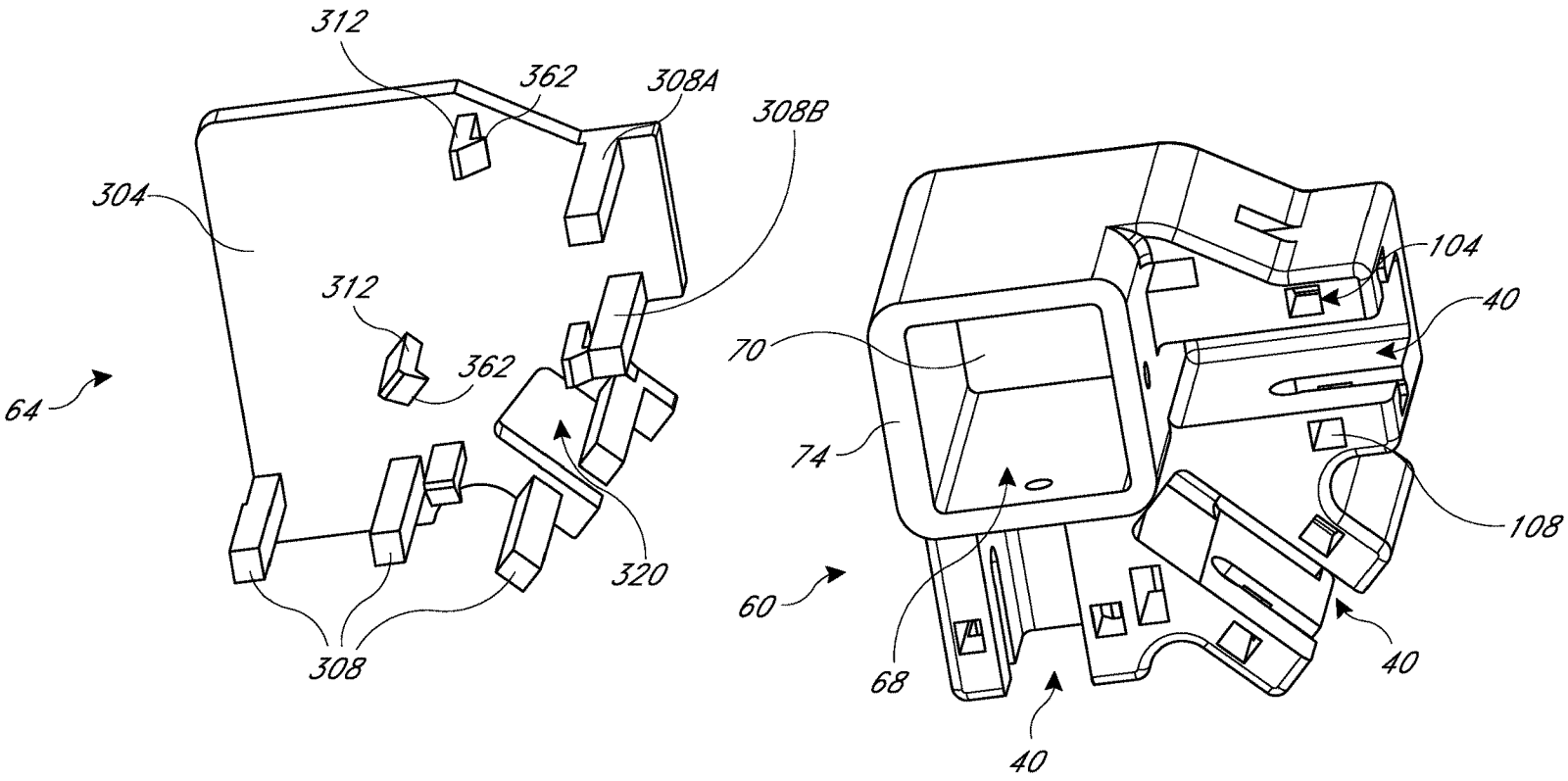
FIG. 3A is a bottom perspective and exploded view of the upper mount of FIG. 2.
Figure 4:
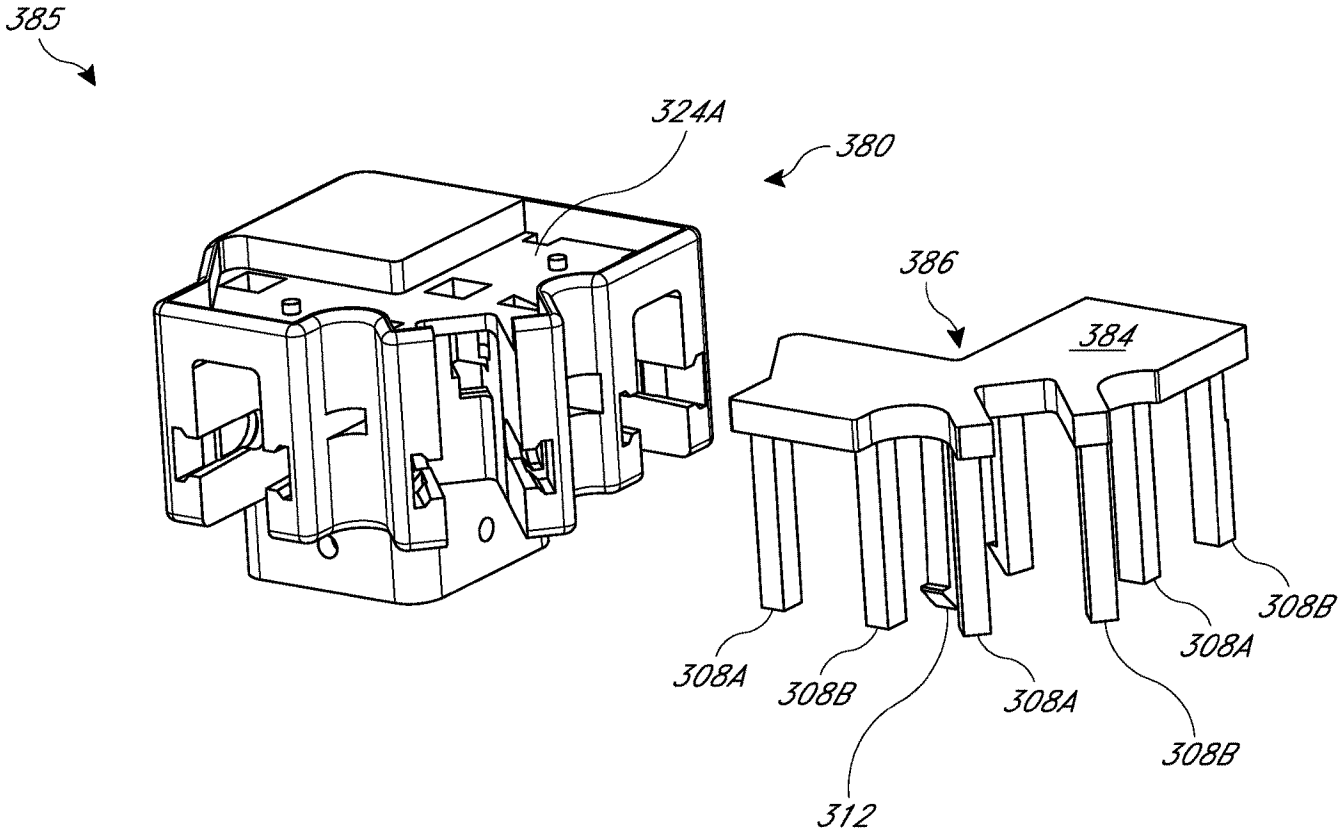
FIG. 4 is a modified embodiment of the upper mount of FIG. 3.
Figure 5:
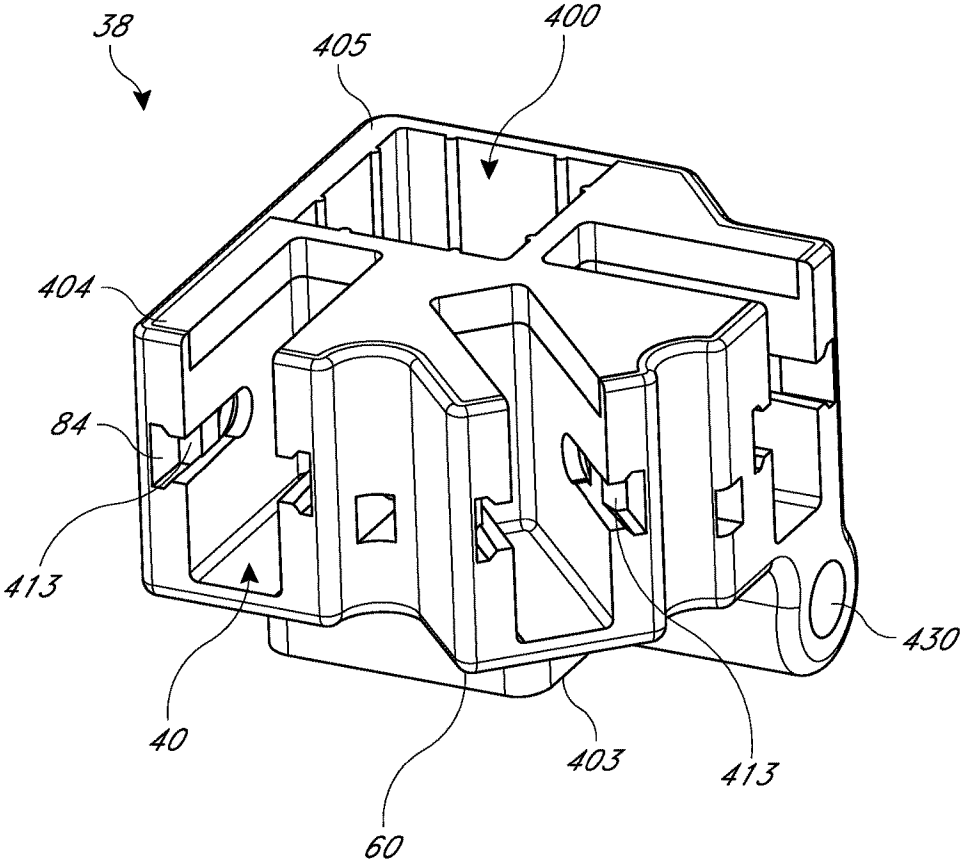
FIG. 5 is a perspective view of a moveable mount assembly.
Figure 6:
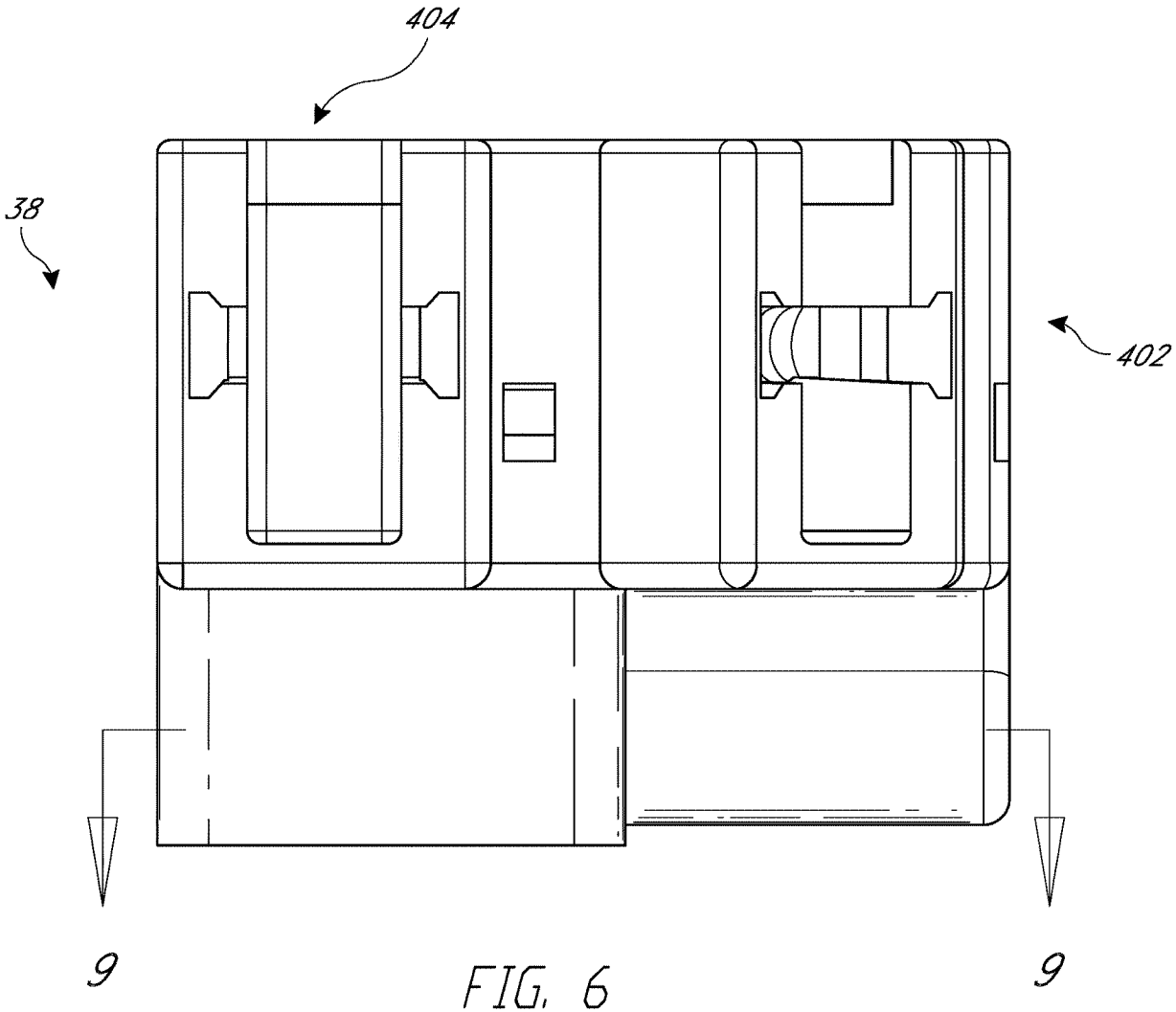
FIG. 6 is a side view of the moveable mount of FIG. 5.

FIGS. 2 to 4 illustrate embodiments of the upper mount 30 that is configured for the pavilion 10. The upper mount 30 includes a base 60 and a cover 64. The base 60 includes a space 68 formed therein. The space 68 is configured to receive the leg 22. The space 68 extends from a bottom surface of the base 60 to a surface 70 located within and enclosed by the base 60. The surface 70 located in the base 60 encloses the top of the leg 22 in one assembly. With reference to FIG. 2, the base 60 can be moved down over the upper end 26 of the leg 22, e.g., until the surface 70 rests on top of the upper surface of the upper end 26. The base 60 also includes a plurality of grooves 40 configured to receive end portions of the ribs 34 when the base portion 60 is coupled with the ribs 34. In some embodiments, the grooves 40 are configured to pivotably receive the ribs 34. The grooves 40 can all have the same configuration or can have different configurations. In one embodiment, the grooves 40 are disposed between opposed walls 72 of the base 60. The grooves 40 can be U-shaped in a horizontal cross-section. FIG. 3A shows that the grooves 40 can be disposed on one side of the base 60, such as on only one side of a plane that extends vertically through two diagonally opposed corners of a structure 74 surrounding the space 68. The grooves 40 can be disposed on a side of the base 60 that faces inward toward the shaded area of the pavilion 10. In this context, facing inward includes facing along the sides of the pavilion, e.g., in the direction of the ribs 34, 42. The side of the base 60 disposed away from the sheltered area of the pavilion can be free of the grooves 40.

FIG. 3 shows that the base 60 includes a first base groove 40 disposed along a first side surface of the base 60 and a second base groove 40 disposed along a second side surface of the base 60. Where the pavilion 10 is configured as a four sided structure, the first and second side surfaces can be disposed perpendicular to each other. A third base groove 40 is provided. The third base groove 40 is located between the first and the second base grooves 40. For example, the third base groove 40 can be at about a forty-five degree angle to at least one of the first base groove 40 and the second base groove 40. The third base groove 40 extends from an internal corner portion. The internal corner portion is disposed on a side of the upper mount 30 that faces inwardly toward the shaded or sheltered area of the pavilion 10. The third base groove can have the same configuration as the first and second base grooves. In some embodiments, the pavilion 10 has a roof that rises above the upper mount 30. That is a central portion of the pavilion 10 is higher than the mount 30. As such, the third base groove 40 can be configured to allow a rib to pivot in the third base groove 40 both above and below the cover 64. The first and second base grooves 40 can be configured to allow a rib 34 coupled therewith to pivot below the cover 64 but not above. As discussed further below, the cover 64 can enclose the first and second groove 40 from above. The third base groove 40 can extend through the base 60 such that the third base groove 40 is open at a top and at a bottom portion thereof. The first and second grooves 40 are open at the bottom portion but are enclosed at the top portion.

The base 60 can have a pin retention recess 84 disposed therein. The pin retention recess 84 can be formed in the opposed walls 72. The pin retention recess 84 can be configured to receive and retain a pin 88 on a first end 92 of the rib 34. The pin retention recess 84 preferably is configured to at least temporarily secure the pin 88 therein. In certain embodiments, the upper mount 30 has secondary securement features as discussed further below.

The base 60 has a top surface 100 that comprises a first opening 104 disposed on one side of one of the grooves 40 and a second opening 108. The second opening 108 is disposed on the base 60 such that the groove 40 is disposed between the first opening 104 and the second opening 108. The first opening 104 and the second opening 108 extends into the base 60. The openings 104, 108 extend to an elevation below the pin retention recess 84 formed in the base 60. FIGS. 3 and 3A shows that the openings 104, 108 intersect and extend thorough the pin retention recess 84. As discussed further below, a blocking member can be inserted into the openings 104, 108 such that when positioned in one of the openings 104, 108 the blocking member encloses a portion of the pin retention recess 84. The portion of the pin retention recess 84 that is enclosed can be disposed away from a side of the base 60 that receives the ribs. As a result, the blocking member can prevent the rib from slipping out of the mount 30.

Figure 3B:
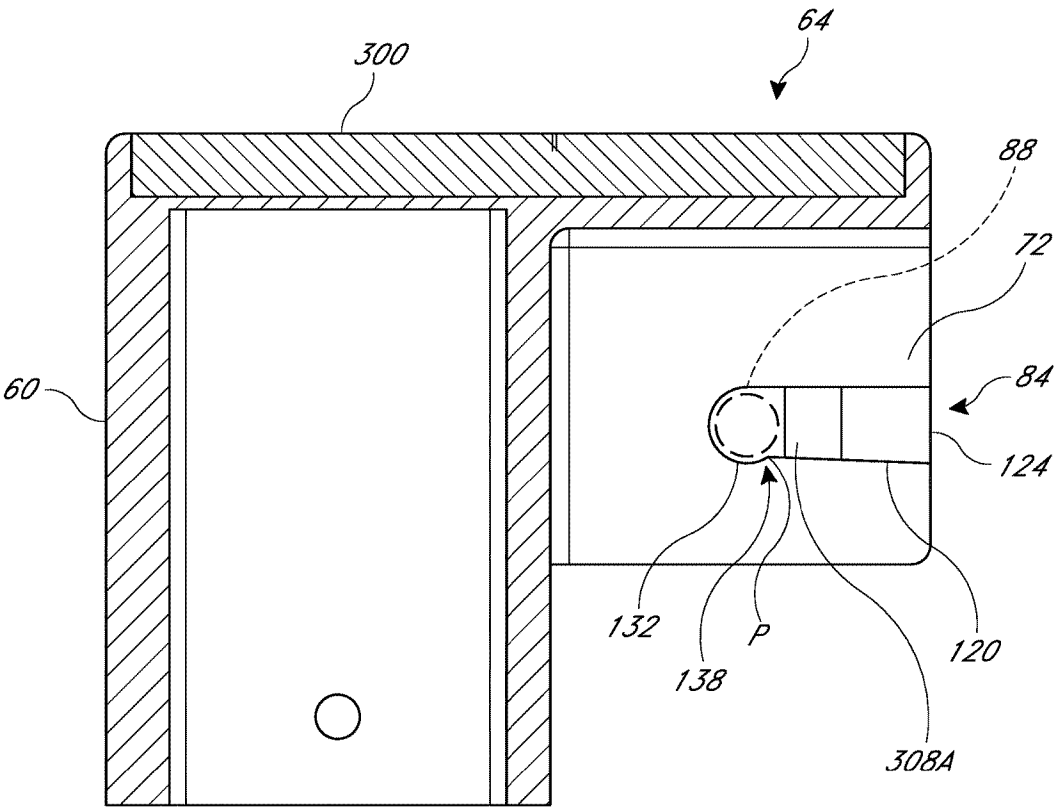
FIG. 3B is a cross-section view of the upper mount of FIG. 2 showing details of a pin retention recess.

FIGS. 3B show the pin retention recess 84 in more detail. In particular, the pin retention recess 84 includes a slot 120 that has an opening 124 on a side surface of the base 60. An enclosed end 132 of the slot 120 is disposed within the base 60. The enclosed end 132 is disposed away from the opening 124 such that a length of the slot 120 is disposed between the opening 124 and the enclosed end 132. One side of the slot 120 is open to the groove 40.

Figure 3C:
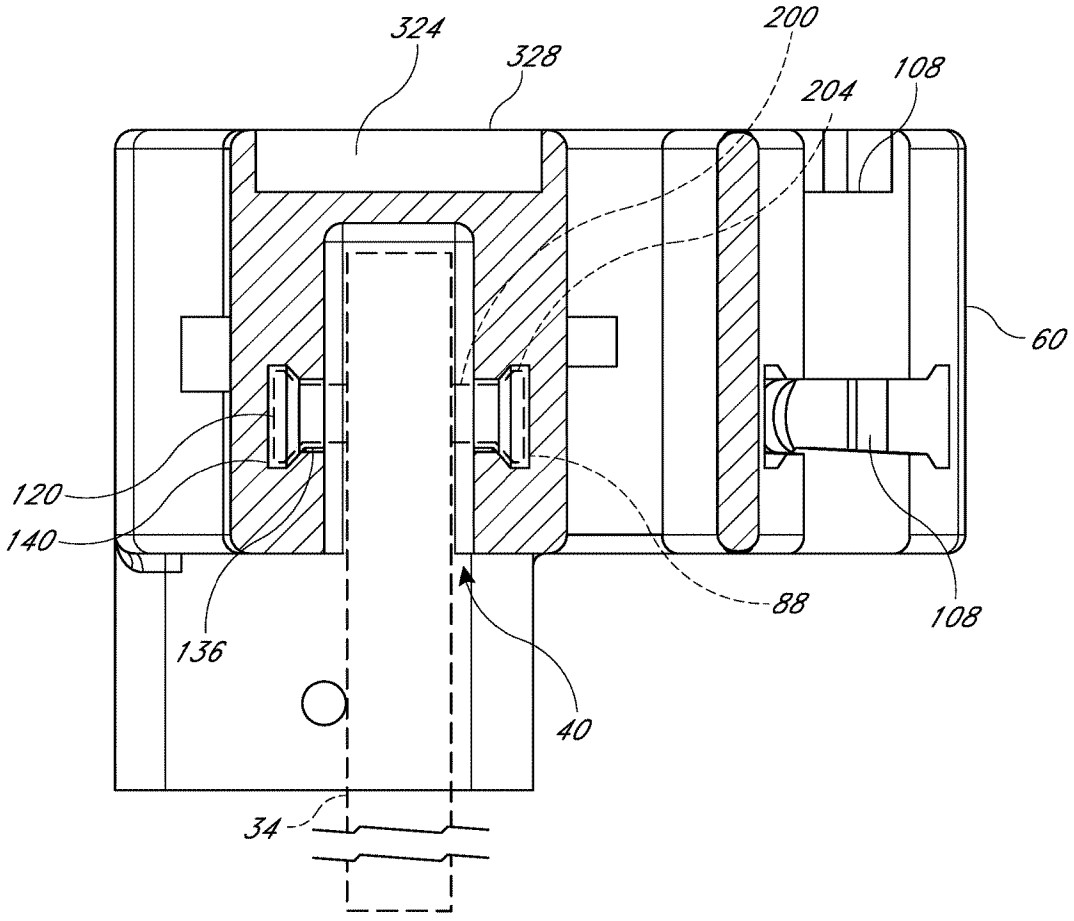
FIG. 3C is a cross-section view of a base of the upper mount of FIG. 2 showing details of a pin retention recess.

The slot 120 includes a constricted portion 136 adapted to secure a portion of a rib such that the rib can be retained in the groove 40 prior to securing the cover to the base. In one embodiment, the slot 120 includes an expanded portion 140. The constricted portion 136 is disposed, in one embodiment, between the expanded portion 140 and the groove 40 on the base 60. FIG. 3C shows that in one embodiment each of the slots 120 has a C-shaped or inverse C-shaped perimeter in a cross-section taken perpendicular to the length of the slot 120. In one embodiment, only one of the slots 120 on the opposing walls 72 of a grooves 40 has a C-shaped or inverse C-shaped profile and the slot on the opposing wall can have a constant height from the wall 72 into the base 60 in a direction away from the groove 40.

FIG. 3C shows that the pin 88 can have a non-cylindrical shape. For example the rib 34 can have an elongate member 90 that extends between the first end 92 and a second end (not shown). The pin 88 extends from the first end 92 of the elongate member. The pin 88 can have a first perimeter 200 at a first location adjacent to the first end 92 of the elongate member 34 and a second perimeter 204. The second perimeter 204 is at a second location disposed laterally of the first location. The second perimeter 204 is larger than the first perimeter 200. If both ends of the pin 88 have this arrangement, the pin 88 may be described as I-shaped and the coupling of the rib 34 with the base 60 is an I-shaped engagement therebetween. The rib 34 is secured in the base 60 by disposing the first location of the pin 88 in the constricted portion 136 of the slot 120 and the second location of the pin 88 in the expanded portion 140 of the slot 120 as illustrated in FIG. 3C.

Figure 3D:
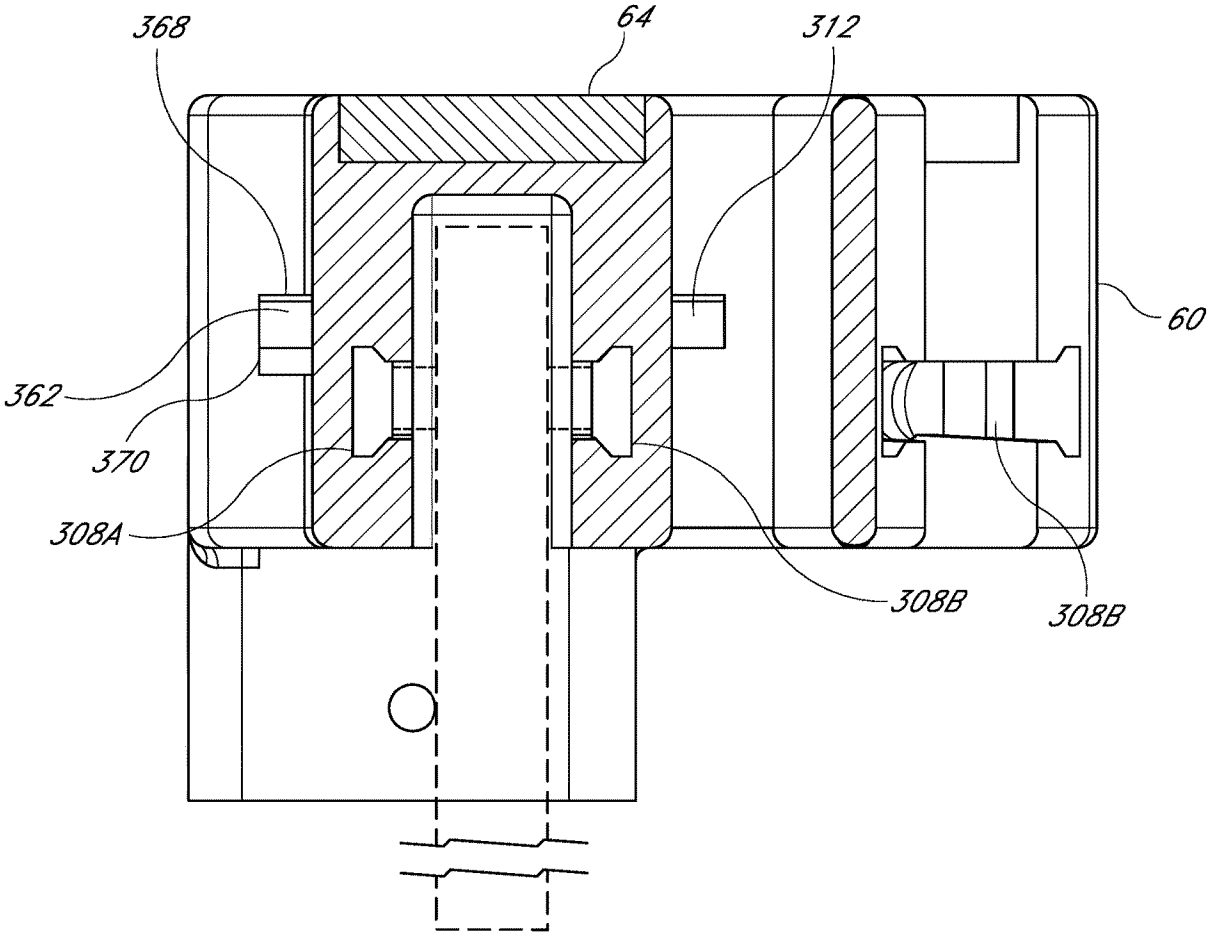
FIG. 3D is another cross-section view of the upper mount of FIG. 2 showing details of a pin retention recess.
Figure 3E:
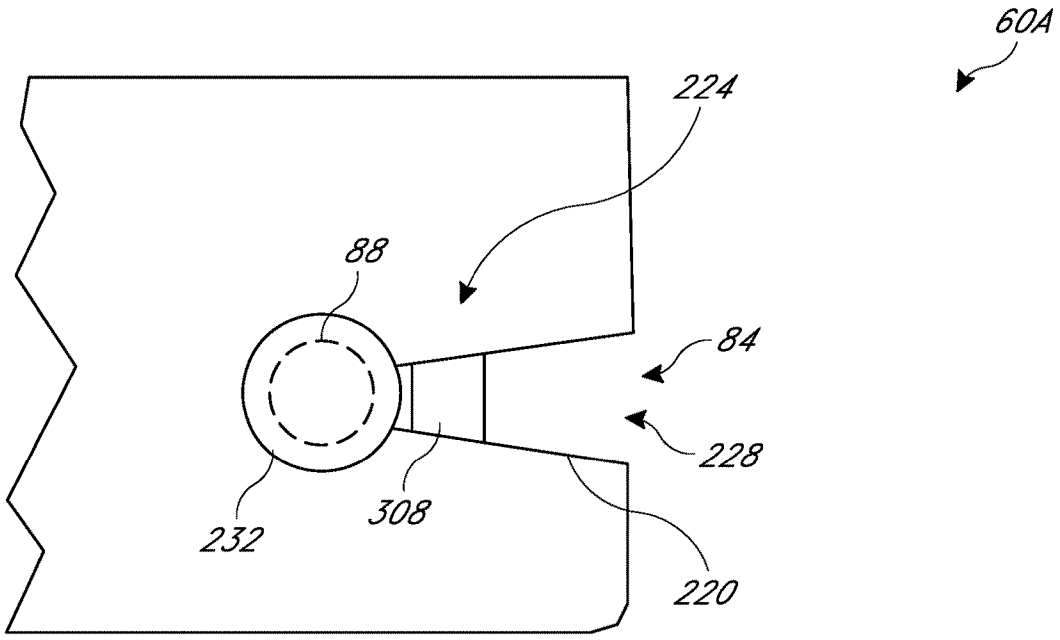
FIG. 3E is a cross-section view of another embodiment of a base of the upper mount of FIG. 2 showing details of another pin retention recess.

FIG. 3E is a schematic view of one opposed wall 72 of one groove 40 of another embodiment of the base 60A. The base 60A can have all the other features of the base 60 including being configured to couple with the cap 64. FIG. 3E shows that a slot 220 can be provided that includes a constricted portion 224 disposed along the length thereof between an opening 228 and an enclosed end 232 of the slot 220. Upper and lower portions of the slot 220 converge toward each other in a direction from the opening 228 to the enclosed end 232. In this embodiment, the rib 34 can be configured such that the pin 88 is cylindrical. The pin 88 need not have an enlarged portion toward the lateral end of the pin. In some embodiments, the pin 88 can be cylindrical with a constant radius along the length thereof. In other embodiments, the pin 88 can have enlarged ends, such as an I-shaped profile. The convergence of the upper and lower portions of the slot 220 can result in the gap between the upper and lower portions being reduced along the length of the slot 220. The reduction of the gap can result in the gap being less than the diameter or minor axis if the pin is non-circular of the pin 88. As a result, to move the pin 88 from the opening 228 to the enclosed end 232 may be achieved by an increased force in the direction from the opening 228 to the enclosed end as the gap reduces. In one embodiment, the constricted portion 224 is deformed or compressed by the pin 88 as the pin passes through the narrowest part of the constricted portion 224. Once the pin 88 passes through the narrowest portion of the gap between the upper and lower portions the pin 88 moves to the enclosed end 232. Once in this position, extracting the pin 88 from the enclosed end 232 requires at least the increased amount of force. As a result the pin is at least temporarily retained in the slot 220, e.g., during assembly until the cap 64 is placed over the base 60 as discussed further below. When so placed a projection 308 of the cap 64 encloses the slot 220 trapping the pin 88 in the enclosed end 232. The constriction of the slot 220 provides for temporary securement of the pin 88.

The base 60 also provides at least some temporary securement of the pin 88 and a rib coupled therewith. FIG. 3B shows that a top of the slot 120 can be aligned with a top surface of the mount 30. The lower edges of the slot 120 can be sloped resulting in a narrowing of the slot from the opening 124. As a result, the pin 88 can be retained by an inflection point P of the lower edge of the slot 120. The inflection point P would be at an elevation higher than the adjacent perimeter between the inflection point P and the enclosed end 132.

FIGS. 2-4 illustrate the cover 64 and how it couples with the base 60 to secure the rib 34 in the upper mount 30. The cover 64 has a top surface 300 and a bottom surface 304. A plurality of projections 308 that have a first end fixed to the bottom surface 304 of the cover 300 and a second end disposed away from the bottom surface 304. In one embodiment, the plurality of projections 308 on the cover 64 comprises a first projection 308A and a second projection 308B. The projections 308 can be integrally formed with the bottom surface 304. The projections 308 can be all substantially the same in configuration. In certain figures the projections are labeled with separate reference numbers to show how they act on opposing sides of the pin 88, but can still be substantially the same in their form but disposed in spaced apart locations. One of the projections 308 is configured to enclose a portion of the retention recess 84. In certain embodiments one of the projections 308 is configured to block one end of the pin 88. As discussed above, the openings 104, 108 extend into the base and intersect the slot 120. FIG. 3D shows that when the projections 308A, 308B are positioned in the base 60 the projections extend through the slot 120 fully enclosing a portion of the slot between the projections 308A, 308B and the enclosed end 232. In some embodiments, one or a plurality of projections 312 are disposed on the bottom surface 304 of the cover 64 and is configured to secure the cover 64 to the base 60.

The first and second projections 308A, 308B are positioned on the cover 64 such that when the cover 64 is coupled with the base 60 the first projection 308A is disposed in the first opening 104 and the second projection 308B is disposed in the second opening 108. The first projection 308A encloses a first pin retention feature 84 and the second projection 308B encloses a second pin retention feature 84. FIG. 3 shows that the first opening 104 and the first retention feature 84 are disposed on or in one of the opposed walls 72 of one of the grooves 40 and the second opening 108 and the second retention feature 84 are disposed on or in the other of the opposed walls 72 of the same groove 40.

In one embodiment, the plurality of projections on the cover comprises a third projection 312 having a first end fixed to the bottom surface 304 of the cover 64 and a second end disposed away from the first end. The second end is adapted to couple with the base 60 in a manner preventing removing the cover 64 from the base 60. The cover 64 can comprise a groove 320 defined between a first projection and a second projection. The groove 320 is located on the cover 64 to be disposed over the groove 40 located on the base. The groove 320 extends through the bottom surface 304 to the top surface of the cover 64 to allow a rib of the frame 14 to rotate to a position disposed at least partially above the upper mount 30.

The upper mount 30 and the moveable mount 38 can be configured with a flush configuration when the base and cover are coupled together. For example, the base 60 can have a recessed portion 324 or area in the upper portion thereof. The recessed portion 324 can be surrounded by side walls 328 that have a height that is equal to or greater than the thickness of the cover 64. Where the thickness of the cover 64 is about the same as the height of the walls 328, a flush configuration is provided. Further, because the projections 308, 312 extend from a bottom surface of the cover 64 the top surface of the cover can be free of openings for screws or other fasteners. This provides not only a flush and attractive appearance, but also prevents water or debris from being lodged therein, which results in a better looking device that is also longer lasting. Also, the cover 18 can be stretched over the upper mount 30 in some embodiments. Accordingly, having a smooth flush surface can provide the advantage of reducing wear of the cover 18 in the location over the mount 30.

The upper mount 30 has a number of advantages. As discussed above, the base 60 is configured to retain the rib 34 therein prior to coupling the cover 64 with the base 60. See FIGS. 3B and 3C. As a result, a plurality of ribs 34 can be coupled with the base 60 prior to full assembly of the upper mount 30. The base 60 also is configured to temporarily retain the pin 88 and the ribs 34 in in the slot 120 by virtue of a C-shaped arrangement of the slots 120. In particular the C-shaped slots 120 oppose tilting of the ends of the pins 88 and thus control a degree of freedom of the ribs 32. If the pins 88 have an I-shaped configuration, then both ends of the pin oppose tilting of the pins 88 and the ribs 32 in the groove 40. The length of the slot 120 prevents short axial shifting of the rib from dislodging the rib 34 from the base 60. In certain embodiments the enclosed end 132 of the slot 120 has an inflection point P where the enclosed end 132 extends downward from the slot 120. The inflection point P can also allow the pin 88 to rest in a concave area. The inflection point P can oppose even small axial movements under the typically small forces that may arise in manufacturing. Full assembly of the cover 64 with the base 60 results in the projections 308A, 308B of the cover 64 of the upper mount 30 blocking egress of the ribs 34 from the base 60. Because the projections 308A, 308B extend through bulk portions of the opposed walls 72 both above and below the slots 120 the projections have a great deal of reinforcement and will not yield even under higher than normal forces.

If the slot 120 is one that converges along the axis thereof as in FIG. 3E, a preliminary securement between the base 60A and the rib 34 is provided by having to move the pin 88 of a diameter larger than the smallest gap in the slot 220 through the smaller gap. As such, the pin 88 is initially retained in the base 60 prior to securement of the cover 64 with the base 60A.

The upper mount 30 is configured such that the cover 64 is manually coupled with the base 60 by inserting the projections 308, 312 into corresponding openings in the cover. The projections 308A, 308B are inserted into the openings 104, 108. The projections 312 are inserted into separate openings 350. The opening 350 and the projections 312 are disposed on the cover 64 such that the projections 312 are aligned to each of the openings 350. The projections 312 can have a hook-like feature on a free end 362 of the projection 312. The hook-like feature can include a lateral projection facing the bottom surface 304 of the cover 64. The lateral projection can be placed against a corresponding surface 368 in the base 60. An advantage of this design is enabling the base 60 and the cover 64 to be secured by a single insertion motion. A highly secure configuration can be provided by increasing the number of projections 312 from one to a plurality of projections. An embodiment with four projections 312 would be particularly secure. Apertures 370 can be provided in the base 60 such that the projections 312 can be accessed to allow them to be disengaged from the surface 368 of the base 60 for disassembly of the mount 30. The projection 312 can initially be deflected upon insertion of the cover 64 into the base 60. The projection 312 can be resilient such that it returns to a less or un-deflected configuration when it reaches the aperture 370. At this point the lateral projection of the hook-like feature can face the corresponding surface 368.

FIG. 4 shows another embodiment of an upper mount 380. The upper mount 380 includes a smaller recessed surface 324A in the base 385. A cover 384 of the upper mount 380 also has a smaller area than the cover 64. The area of the cover 384 is limited to providing connection between and structural integrity among the projections 308 and the projections 312. The cover 384 has a first lateral portion with a plurality of projections 312 and a second later portion with a plurality of projections 312. A narrow section 386 is provided between the first and second lateral portions. One advantage of the upper mount 380 is that a portion 387 of the base 385 is not recessed. The portion 387 provides a thicker area of material disposed over the leg 22. The thicker are of the portion 387 can enhance the weight bearing area of the upper mount 380.

FIGS. 5-9 illustrate embodiments of the moveable mount 38 in further detail. The moveable mount 38 has features that are the same or analogous to those of the upper mount 30 described above. Any and all such features are incorporated into the description of the moveable mount 38 set forth herein.

The moveable mount 38 includes a space 400 formed in the base 402 of the mount 38 extends from a lower surface 403 of the base 402 to an upper surface 405 of the moveable mount 38. That is, the space is a channel that extends entirely through the moveable mount 38.

Figure 8:
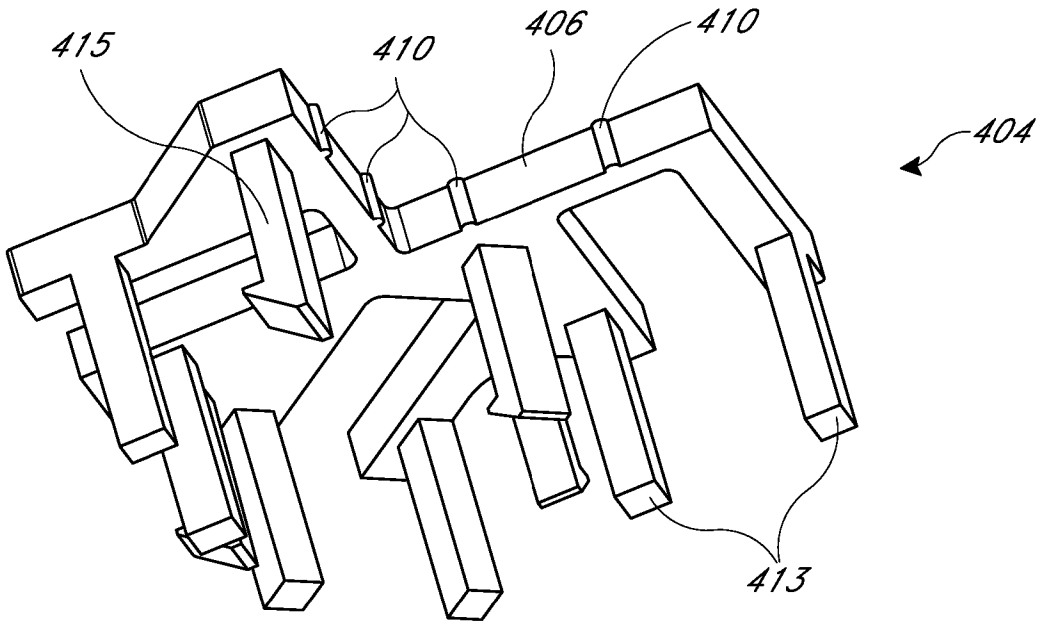
FIG. 8 is a bottom perspective view of a cap of the moveable mount assembly of FIG. 5.

A cover 404 of the moveable mount 38 has a different configuration than the cover 64. For example, to accommodate the space 400 extending entirely through the moveable mount 38 the cover 404 has less coverage of the top of the base 402. One side 406 of the cover 402 partly defines the space 400. FIG. 8 shows that the side 406 includes contact features 410 that extend in the direction of movement of the moveable mount 38. The features 410 comprise edges that reduce the contact area of the moveable mount 38 with the leg 12 and thus reduce friction in the sliding contact. The edges may provide line contact.

Figure 7:
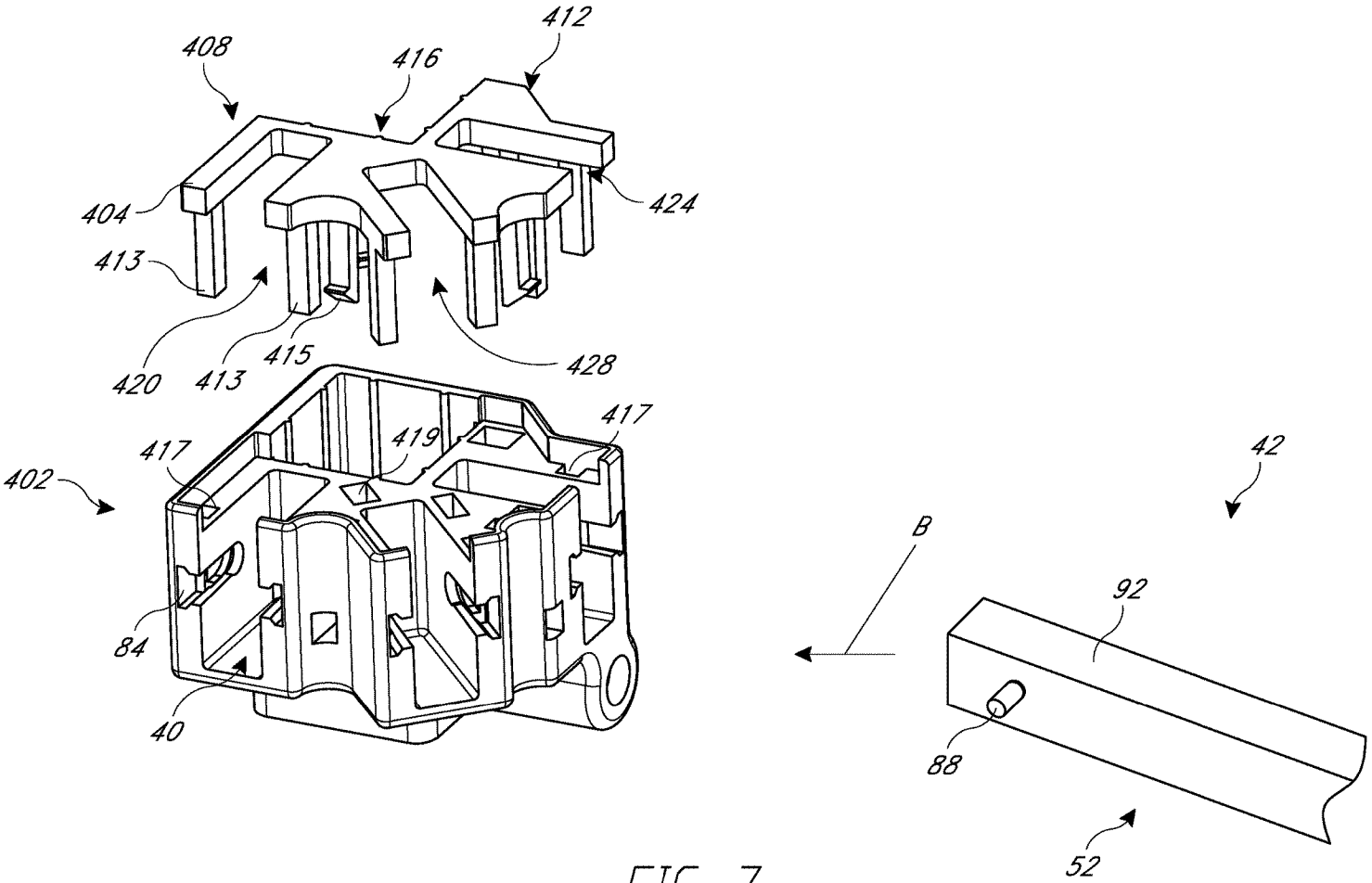
FIG. 7 is an exploded view of a pavilion assembly that includes the moveable mount assembly of FIG. 5.

FIG. 7 shows that in one embodiment, the cover 404 comprises a first lateral portion 408, a second lateral portion 412, and a central portion 416 disposed between the first and second lateral portions 408, 412. A first cover groove 420 disposed between the first lateral portion 408 and the central portion 416 and a second cover groove 424 disposed between the second lateral portion 412 and the central portion 416. A third cover groove 428 extends through the cover between the first and second cover groves 420, 424. Each of the first lateral portion 408, the second lateral portion 412, and the central portion 416 comprises projections extending therefrom. The first, second and central portions 408, 412, 416 can comprise general regions of an otherwise continuous expanse of the cover 404.

Figure 9:
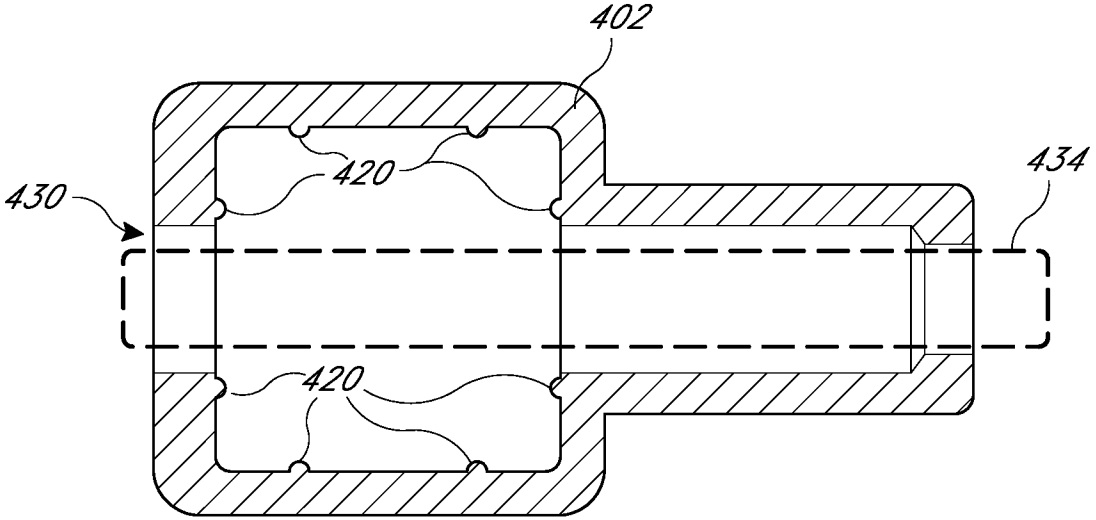
FIG. 9 is a cross-section view of the moveable mount taken at section plane 9-9 in FIG. 6.

FIG. 9 shows that the base 402 can have one or a plurality of contact features 420. The contact features 420 can be disposed along the space 400. The contact features 420 can be disposed parallel to the direction of movement of the moveable mount 38 along the leg 22. The contact features 420 can include edges that provide line contact along the leg 22. In other embodiments a low friction insert can be placed in the space 400 to be disposed between the mount 38 and the leg 22.

In one embodiment, the mount 38 can have a securement feature 430 disposed thereon. The securement feature 430 can enable the moveable mount 38 be positioned at any of select positions along the leg 22. For example a plurality of holes can be formed long the leg 22. A pin 434 can be inserted through the feature 430 and through one of the holes in the leg to hold the moveable member 38 at the selected elevation.

Figure 10:
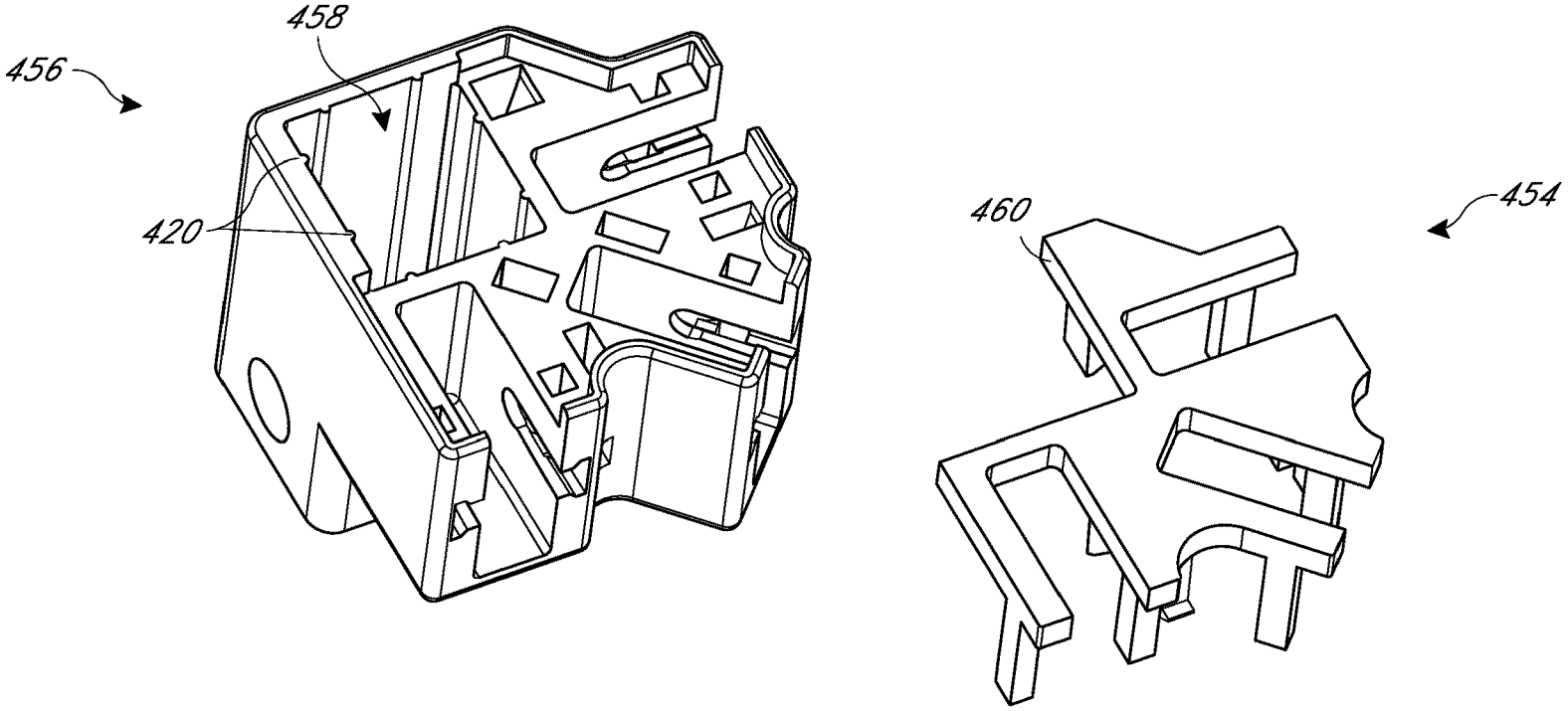
FIG. 10 is a modified embodiment of the stationary mount assembly of FIG. 5.
Figure 11:
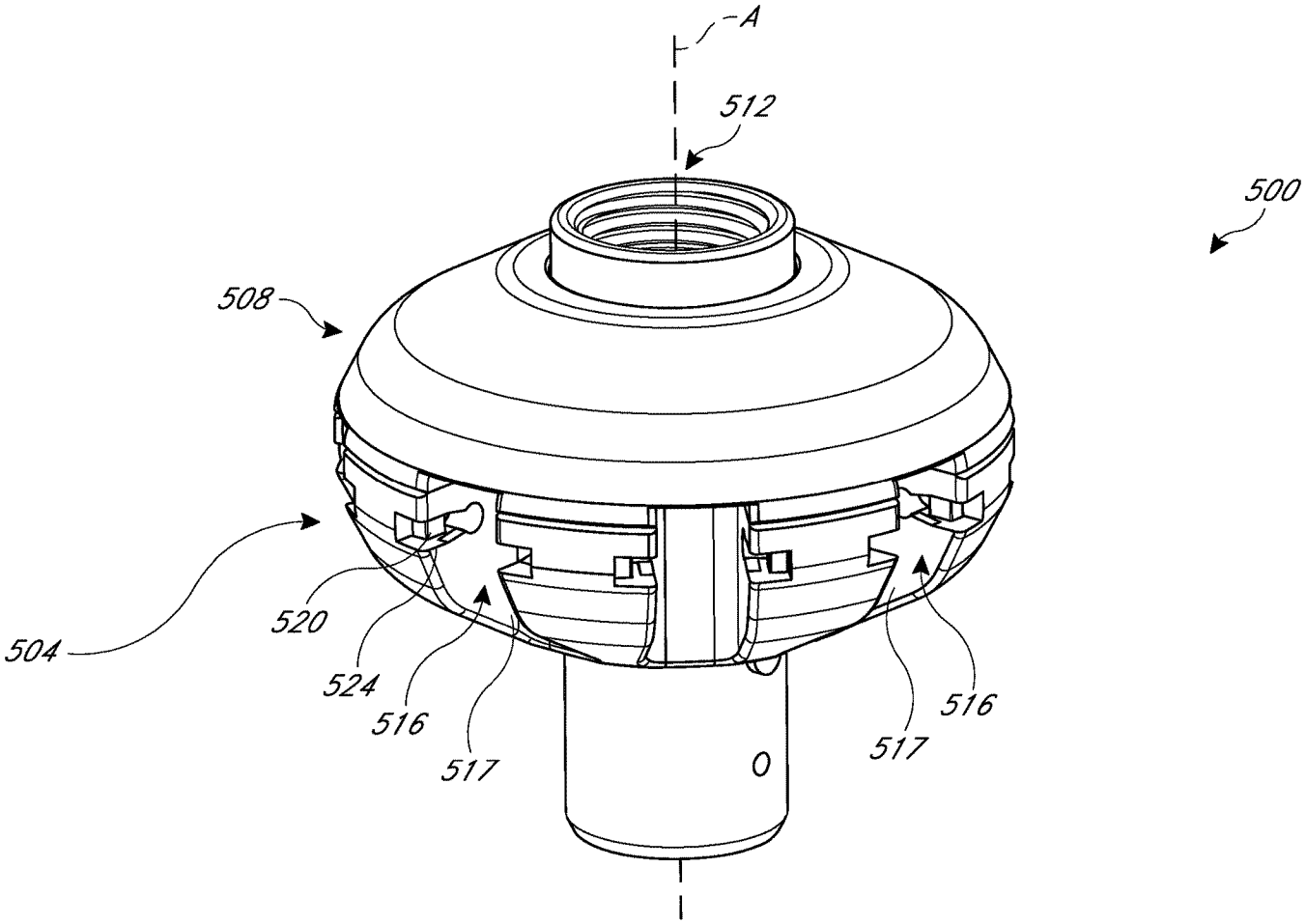
FIG. 11 is a top perspective view that illustrates umbrella top notch or umbrella hub assemblies with convenient rib retention features.
Figure 12:
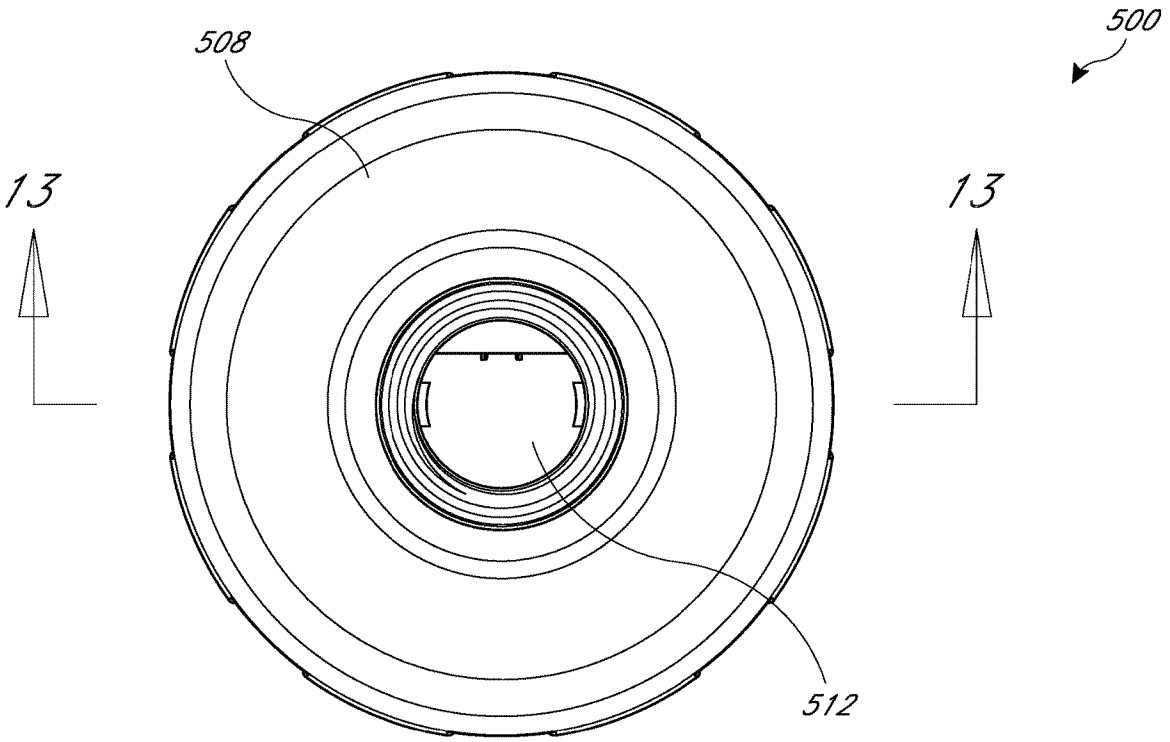
FIG. 12 is a top view of the umbrella hub assembly of FIG. 11.

FIG. 10 shows another embodiment of a moveable mount 450. The mount 450 includes a cover 454 and a base 456 that partly defines a space 458 for movement along the leg 22. The cover 454 includes a smooth surface 460 disposed opposite contact features 420. In contrast the cover 408 can have contact features as discussed above.

The upper mount 30 can be secured to a plurality of ribs 34 in the following methods. FIG. 3 shows the rib 34 disposed away from the base 60. By a motion in the direction of the arrow A, the rib 34 is inserted into one of the grooves 40. The pin 88 of the rib 34 can have an I-shaped profile as illustrated in FIGS. 3C. The C-shaped slots 120 cooperate with the I-shaped pin 88 to constrain one or multiple degrees of freedom once the pin 88 is initially inserted into the slots 120. The insertion of the pin 88 continues toward the inflection point P. After the pin 88 reaches the inflection point P the pin 88 settles into the concave area below the inflection point P. See FIG. 3B. This provides at least a temporary rib retention function during additional assembly. If the constricted passage configuration of FIG. 3E is used, then the pin 88 is directed through the constricted portion 224 by an increasing force as the walls approach each other. Assembly can continue with additional ribs in the other grooves 40 of the mount 30 if present. Once the rib or ribs are installed, the cover 64 can be moved to a position over the top of the base 60 as in FIG. 3. The projections 308, 312 are aligned with corresponding apertures in the base 60. The cover 64 is advanced relative to the base 60, with the projections sliding in the corresponding openings. The projections 308A are aligned with the apertures 104 and the projections 308B are aligned with the apertures 108. The projections 312 are aligned with the apertures 350. Full advancement causes the projections 308 to span the slots 120 as shown in FIGS. 3B and 3D. The projections 312 also are positioned such that the free ends 362 are disposed on the surfaces 368, resisting removal of the cover 64. In this position the cover 64 may be received in the recessed space 324 such that the top surface thereof is flush with the top of the side walls 328.

The rib 42 can be assembled to the moveable mount 38 in substantially the same way. For example, the rib 42 can be inserted as indicated by the arrow B. The initial retention of the rib 42 in one of the grooves 40 can be in the same manner as discussed above in connection with the rib 34. For example, the pin 88 can be I shaped and the slots 120 can be C shaped. An inflection point P can be disposed between an enclosed end 132 of the slot 120 and the opening 124 to the slot 120. If the constricted passage configuration of FIG. 3E is used, then the pin 88 is directed through the constricted portion 224 by an increasing force as the walls approach each other. Thereafter the cover 404 is secured to the base 402 in much the same manner discussed above.

FIGS. 11-14 illustrate various ways in which the embodiments discussed above can be incorporated into an umbrella. A top notch or upper hub 500 is provided that has a base 504 and a cover 508. The upper hub 500 is one form of an upper mount. The base can include features of the base 60. Such features are incorporated here into this description in their entirety where not inconsistent. The base 504 is symmetric about an axis A that extends along a direction of an umbrella pole that would extend through a central aperture 512 thereof. An umbrella pole is another example of a ground support.

The base 502 has a plurality of grooves 516 disposed around the outer periphery thereof. The grooves 516 are suitable for pivotably coupling with a rib 518. Pin retention recesses 524, which can include a slot similar to the slot 120 or the slot 220 discussed above or similar features, are disposed in or on opposed walls within the base 504. Opposed walls 517 of the hub 500 can define the grooves 516. Projections 520 that have a fix end on a bottom surface of the cover 508 and a free end projecting away from the fixed end are disposed across the pin retention recesses 524 in a way similar to that discussed above. As such the projections 520 provide robust retention of the pin 88 of the rib 518. Securement of the cover 508 to the base 504 can be provided by hook-like projections 532. The projection 532 can be similar to the projections 312 discussed above. The description of these features and their connection to the base of the mount 30 are relevant and are incorporated here. The projections 532 can engage a surface 536 disposed in or on an opening in the base 504.

Figure 13:
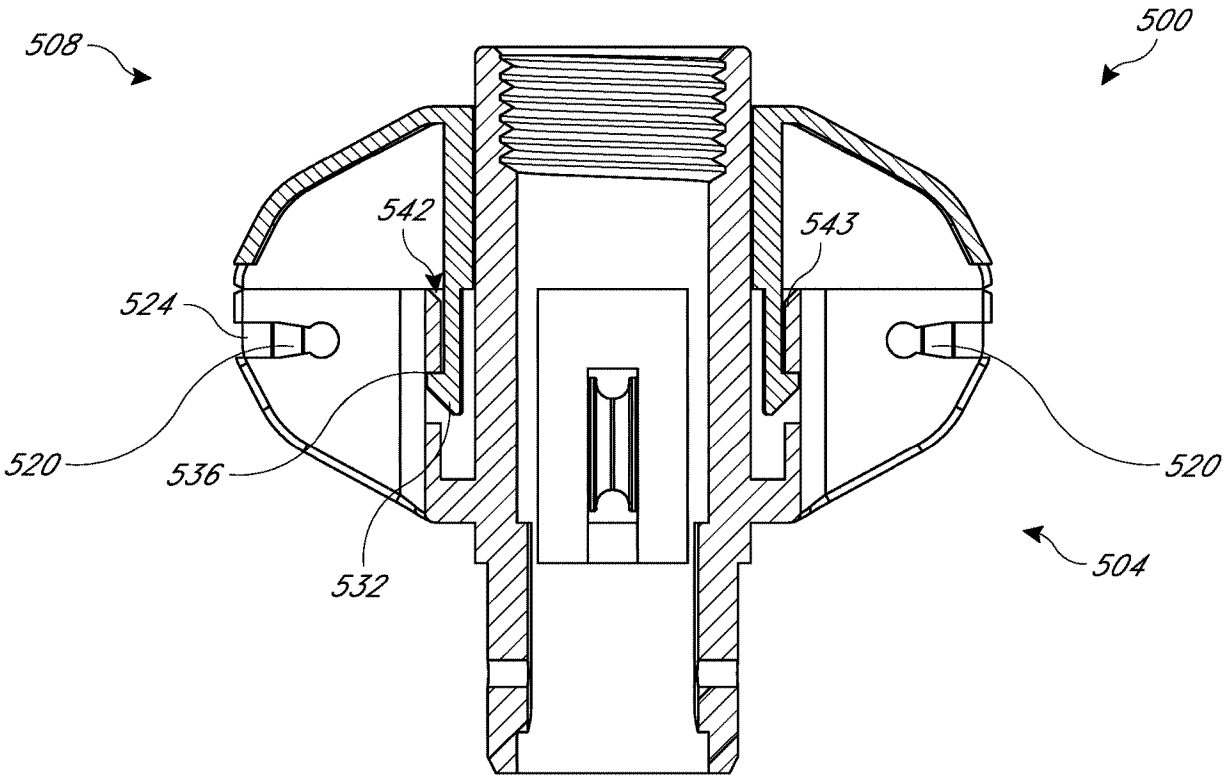
FIG. 13 is a cross-sectional view of the umbrella hub assembly of FIG. 11 taken at section plane 13-13 shown in FIG. 12.

FIG. 13 shows that the recesses 524 can have a funnel-like configuration. That is the slots can be wisest at an opening disposed on the outer periphery of the 500 and can taper inwardly toward a central portion of the recess 524. One or both of the surfaces defining the recesses 524 can taper inwardly. A constricted portion can be formed by this narrowing. The constricted portion can be about the same size as the diameter of the pin 88, e.g., of the smallest diameter of the pin 88.

Figure 14:
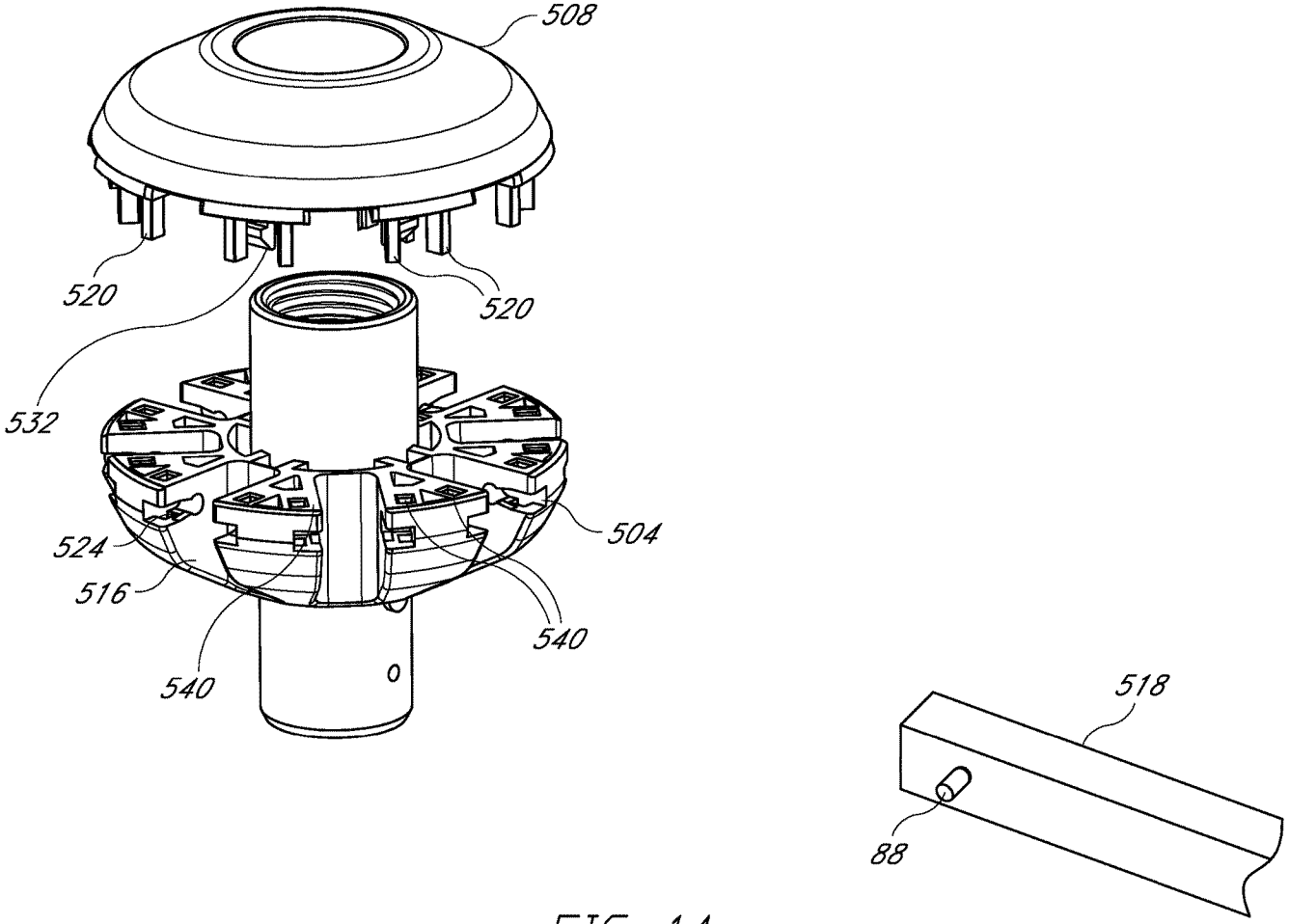
FIG. 14 is an exploded view of an umbrella assembly including the umbrella hub assembly of FIG. 11 and an umbrella rib.

FIG. 14 shows assembly of the hub 500. In particular, the rib 518 is inserted into the hub such that a first end of the rib 518 is in the groove 516. The pin 88 is disposed in the pin retention recess 524, e.g., in a slot similar to the slots 120, 220. A rib may be positioned in each of the grooves 516. Projections 520, 532 are inserted into openings in the base 504. The projections 520 enter opening 540 and are advanced to block the enclosed end of the recess 524 preventing the pin 88 from coming out of the hub 500. The projections 532 of the cover 508 enter opening 542 and are advanced to engage a surface in the base 504 preventing disengagement of the cover 508 from the base 504.

Figure 15:
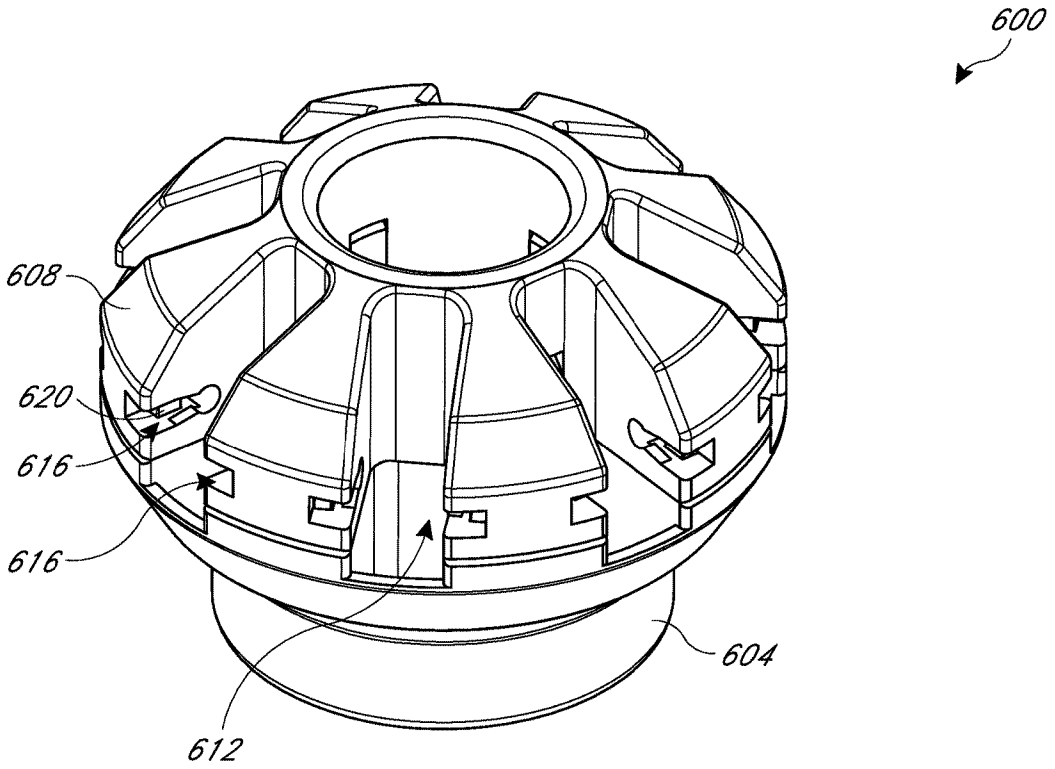
FIG. 15 is a top perspective view that illustrates umbrella runner or lower hub assemblies with convenient rib retention features.
Figure 16:
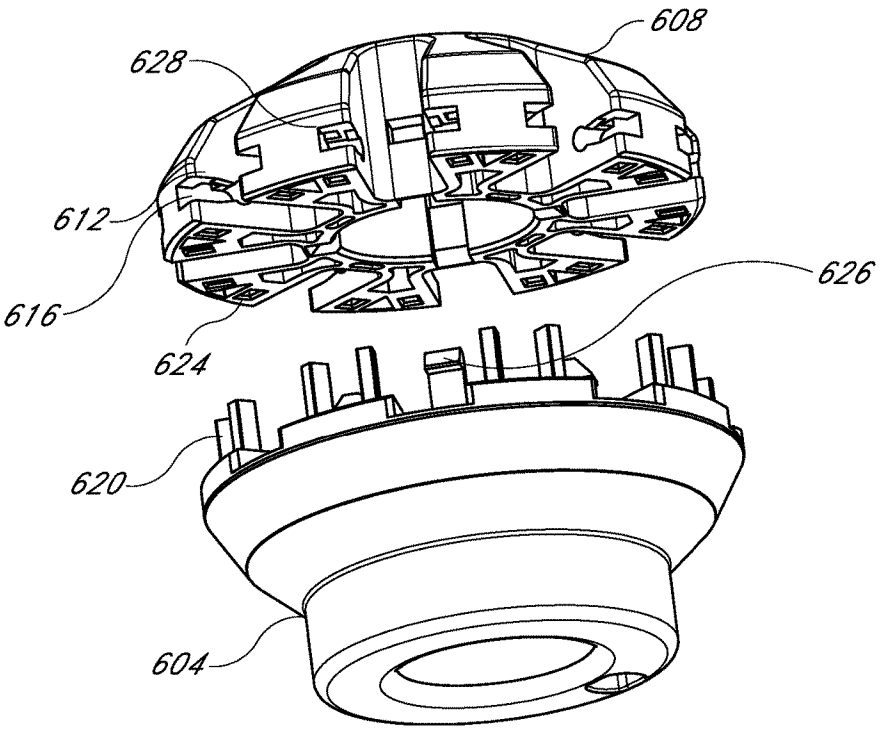
FIG. 16 is an exploded view of the umbrella runner of FIG. 15.

FIGS. 15-16 show a runner 600. The runner 600 is a moveable mount and is in some respects similar to the moveable mount 38 discussed above in the context of a pavilion. The runner 600 is similar to the upper hub 500 in some respects. Analogous features of the devices are incorporated by reference here.

The runner 600 includes a base 604 and a cover 608. Grooves 612 are formed in the cover 608 to pivotably couple with ribs. Pin retention recesses 616 extend from an outer periphery of the cover 608 hub to an enclosed end disposed within the cover 608. Projections 620 on the base extend up into opening 624 the cover and are disposed across the pin retention recesses 616. The projections 620 block egress of a pin of an umbrella rib when the rib is installed in the hub 600 and the cover 608 is coupled with the base 604. Fastening projections 626, which can be hook-like in their configuration, project form the base 604. The projections 626 are received in opening in the cover 608. When so inserted the projections engage the cover 608 in a manner similar to that discussed above.

Assembly of the runner 600 proceeds in a manner similar to the assembly method discussed above.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A shade structure, comprising:

at least one ground support having a lower end and an upper end;

an upper mount coupled with the upper end of the at least one ground support, the upper mount having an upper groove;

a rib having a first end coupled with the upper mount in the upper groove and an elongate body extending away from the first end;

a moveable mount comprising an aperture disposed around the at least one ground support, the aperture configured to allow the moveable mount to move along the at least one ground support, the moveable mount comprising a groove; and a rib having a first end coupled with the moveable mount in the groove thereof and an elongate body extending away from the first end;

wherein at least one of the upper mount and the moveable mount comprises a base configured to receive the rib in the groove thereof and a cover configured to secure the first end of the rib in the groove when the cover is coupled with the base;

a first pin retention recess on a first side of the groove and a second pin retention recesses on a second side of the groove, the first end of the rib comprising a pin configured to be inserted into the first and second pin retention recesses;

a first upper opening within an upper surface of the base adjacent the first side of the groove and a second upper opening within the upper surface of the base adjacent the second side of the groove;

a first lower opening adjacent to the first pin retention recess and a second lower opening adjacent to the second pin retention recess;

first and second projections extending from the cover, the first and second projections being positioned on the cover such that when the cover is coupled with the base, the first projection is disposed through the first upper opening and the first lower opening, the second projection is disposed through the second upper opening and the second lower opening, and the first projection at least partially blocks the first pin retention recess and the second projection at least partially blocks the second pin retention recess;

wherein the pin of the first end of the rib is coupled with the base within the first and second pin retention recesses.

2. The shade structure of claim 1, wherein the base is configured to temporarily secure the corresponding rib therein prior to coupling the cover with the base.

3. The shade structure of claim 1, wherein the cover and the base are configured for single stage manual coupling without separate fasteners.

4. The shade structure of claim 1, wherein the shade structure comprises a collapsible pavilion and the ground support comprises a leg of a pavilion.

5. The shade structure of claim 1, wherein the shade structure comprises an umbrella and the ground support comprises an umbrella pole of an umbrella.

6. A mount for a portable pavilion, comprising:

a base comprising a space formed therein configured to receive a ground support and at least one groove configured to pivotably receive a rib, the groove disposed between opposed walls of the base, the opposed walls each having a pin retention recess disposed therein, the pin retention recess comprising a slot having an open end disposed on a side surface of the base and an enclosed end; and a cover having a top surface, a bottom surface, and a plurality of projections having a first end fixed to the bottom surface of the cover and a second end disposed away from the bottom surface;

wherein a fixed end of a first projection of the plurality of projections is located on the cover such that when the cover is secured to the base the first projection blocks at least a portion of the slot between the enclosed end and the open end of the slot to trap a pivot pin of a corresponding rib disposed between the first projection and the enclosed end of the slot in the base.

7. The mount of claim 6, wherein the space formed in the base extends from a bottom surface of a surface enclosed by the base.

8. The mount of claim 6, wherein the space formed in the base extends from a bottom surface of the mount to a top surface of the mount.

9. The mount of claim 6, wherein a top surface of the base comprises a first opening disposed on one side of the groove and a second opening disposed on the base such that the groove is disposed between the first opening and the second opening, the first opening and the second opening extending into the base to an elevation below the pin retention recess formed in the base.

10. The mount of claim 9, wherein the plurality of projections on the cover comprises a second projection, the first and second projections being positioned on the cover such that when the cover is coupled with the base the first projection is disposed in the first opening and the second projection is disposed in the second opening, and the second projection blocks at least a portion of a slot of a second pin retention recess.

11. The mount of claim 10, wherein the plurality of projections on the cover comprises a third projection having a first end fixed to the bottom surface of the cover and a second end disposed away from the first end, the second end adapted to couple with the base in a manner preventing removing the cover from the base.

12. The mount of claim 10, wherein the cover comprises a groove defined between the first projection and the second projection, the groove located on the cover to be disposed over the groove located on the base.

13. The mount of claim 10, wherein the first pin retention recess comprises a slot having an opening on a side surface of the base, an enclosed end disposed within the base away from the opening and a length disposed between the opening and the enclosed end, the length being open to the groove.

14. The mount of claim 13, wherein the slot has a C-shaped perimeter in a cross-section taken perpendicular to the length of the slot.

15. The mount of claim 13, wherein at least a portion of the length of the slot includes a constricted portion adapted to secure a portion of a rib such that the rib can be retained in the groove prior to securing the cover to the base.

16. The mount of claim 15, wherein the slot includes an expanded portion, the constricted portion being disposed between the expanded portion and the groove on the base.

17. An assembly comprising:

the mount of claim 15; and a rib comprising an elongate member having a first end, a second end, and a pin extending from the first end of the elongate member, the pin having a first perimeter at a first location adjacent to the first end of the elongate member and a second perimeter at a second location disposed laterally of the first location, the second perimeter being larger than the first perimeter;

wherein the rib is secured in the base by disposing the first location of the pin in the constricted portion of the slot and the second location of the pin in the expanded portion of the slot.

18. The mount of claim 15, wherein the constricted portion is disposed along the length of the slot between the opening and the enclosed end.

19. The mount of claim 18, upper and lower portions of the slot converge toward each other in a direction from the opening to the enclosed end.

20. The mount of claim 6, wherein a top surface of the base has a recessed portion configured to receive the cover.

21. The mount of claim 6, wherein the base is configured to retain a rib therein prior to coupling the cover with the base and the cover is configured to block egress of the rib from the base when the cover is coupled with the base.

22. The mount of claim 6, wherein the cover is configured to be manually coupled with the base by inserting the projections into corresponding openings, the cover and the base of the mount having a single engaged position.

23. The mount for a shade structure of claim 6, wherein a second projection of the plurality of projections is configured to secure the cover with the base.

24. A mount for a portable pavilion, comprising:

a base comprising a space formed therein configured to receive a ground support and at least one groove configured to pivotably receive a rib, the groove disposed between opposed walls of the base, the opposed walls having a pin retention recess disposed therein; and a cover having a top surface, a bottom surface, and a plurality of projections having a first end fixed to the bottom surface of the cover and a second end disposed away from the bottom surface;

wherein one of the projections is configured to enclose a portion of the pin retention recess or is configured to secure the cover to the base; and wherein the base comprises a first base groove disposed along a first side surface of the base, a second base groove disposed along a second side surface of the base, the first and second side surfaces being perpendicular to each other, and a third base groove extending from a corner portion of the base; and the cover comprises a first lateral portion, a second lateral portion, and a central portion disposed between the first and second lateral portions, a first cover groove disposed between the first lateral portion and the central portion and a second cover groove disposed between the second lateral portion and the central portion, wherein each of the first lateral portion, the second lateral portion, and the central portion comprises projections extending therefrom.

25. A mount for a portable pavilion, comprising:

a base comprising a space formed therein configured to receive a ground support and at least one groove configured to pivotably receive a rib, the groove disposed between opposed walls of the base, the opposed walls having a pin retention recess disposed therein; and a cover having a top surface, a bottom surface, and a plurality of projections having a first end fixed to the bottom surface of the cover and a second end disposed away from the bottom surface;

wherein one of the projections is configured to enclose a portion of the pin retention recess or is configured to secure the cover to the base; and wherein the cover comprises an array of four coupling projections and six blocking projections.

26. A mount for a shade structure, comprising:

a base comprising a space formed therein configured to receive a ground support of a shade structure;

a cover having a top surface and a bottom surface to be secured to the base;

a groove formed in the mount and configured to pivotably receive a rib, the groove disposed between opposed walls of the mount;

a pin retention recess disposed on each side of the opposed walls in one of the cover and the base;

a plurality of projections having a first end fixed to one of the cover and the base in which the pin retention recess is not formed and a second end disposed away from the fixed end;

wherein one of the projections is configured to enclose a portion of the pin retention recess when the cover and the base are secured together.

27. The mount for a shade structure of claim 26, wherein a pin of a rib coupled with the base is disposed between an enclosed end of the pin retention recess and the second end of the one projection, the second end of the one projection spaced inwardly from an outer periphery of the base and blocking the pin retention recess.

28. The mount for a shade structure of claim 27, wherein the plurality of projections of the cover comprises a number of blocking projections greater than a number of coupling projections.

* * * * *